US005700965A

United States Patent [19]

Rose

[11] Patent Number: 5,700,965

[45] **Date of Patent: *Dec. 23, 1997**

[54] TUNING SYSTEMS FOR STRINGED INSTRUMENTS

[76] Inventor: Floyd D. Rose, 117 Via de la Valle, Del Mar, Calif. 92104

[ * ] Notice: The term of this patent shall not extend beyond the expiration date of Pat. No. 5,522,299.

[21] Appl. No.: 484,120

[22] Filed: Jun. 7, 1995

[51] Int. Cl.[6] ..... G10D 3/00

[52] U.S. Cl. ..... 84/297 R; 84/297 S; 84/312 R; 84/199

[58] Field of Search ..... 84/312 R, 297 R, 84/297 S, 199

[56] References Cited

U.S. PATENT DOCUMENTS

| | | | |
|---|---|---|---|
| 1,475,345 | 5/1923 | Lambert et al. | 84/314 N |
| 2,191,776 | 1/1940 | Schreiber | 84/314 |
| 3,313,196 | 4/1967 | Mari | 84/297 |
| 3,407,696 | 10/1968 | Smith et al. | 84/297 |
| 3,599,524 | 8/1971 | Jones | 84/312 |
| 4,171,661 | 10/1979 | Rose | 84/313 |
| 4,208,941 | 6/1980 | Wechter | 84/298 |
| 4,304,163 | 12/1981 | Siminoff | 84/314 N |
| 4,348,934 | 9/1982 | Ogata | 84/306 |
| 4,366,740 | 1/1983 | Tripp | 84/298 |
| 4,475,432 | 10/1984 | Stroh | 84/314 N |
| 4,497,236 | 2/1985 | Rose | 84/298 |
| 4,608,904 | 9/1986 | Steinberger | 84/304 |
| 4,632,005 | 12/1986 | Steinberger | 84/313 |
| 4,648,304 | 3/1987 | Hoshino et al. | 84/313 |
| 4,656,915 | 4/1987 | Osuga | 84/313 |
| 4,696,218 | 9/1987 | Hoshino et al. | 84/297 |
| 4,882,967 | 11/1989 | Rose | 84/313 |
| 4,945,801 | 8/1990 | Stroh et al. | 84/314 N |
| 5,097,737 | 3/1992 | Uhrig | 84/314 N |
| 5,140,884 | 8/1992 | Bowden | 84/312 R |
| 5,171,927 | 12/1992 | Kubicki et al. | 84/304 |
| 5,191,159 | 3/1993 | Jordan | 84/274 |
| 5,227,571 | 7/1993 | Cipriani | 84/307 |
| 5,265,512 | 11/1993 | Kubicki et al. | 84/298 |
| 5,277,095 | 1/1994 | Steinberger | 84/304 |
| 5,295,427 | 3/1994 | Johnson et al. | 84/307 |
| 5,343,793 | 9/1994 | Pattie | 84/454 |
| 5,347,905 | 9/1994 | Cipriani | 84/298 |
| 5,355,759 | 10/1994 | Hoshino | 84/298 |
| 5,361,667 | 11/1994 | Pritchard | 84/297 R |
| 5,372,057 | 12/1994 | Hart | 84/297 R |
| 5,410,936 | 5/1995 | Ellsworth et al. | 84/298 |
| 5,413,019 | 5/1995 | Blanda, Jr. | 84/298 |

*Primary Examiner*—Michael L. Gellner
*Assistant Examiner*—Shih-yung Hsieh
*Attorney, Agent, or Firm*—Lerner, David, Littenberg, Krumholz & Mentlik

[57] ABSTRACT

A set of strings for use with a stringed instrument, such as a guitar, is provided. The set of strings may include one string or a plurality of strings wherein each string has a predetermined length selected to correspond with a convergence length at which harmonic and pitch tuning are simultaneously obtained.

25 Claims, 19 Drawing Sheets

TUNING SYSTEMS FOR STRINGED INSTRUMENTS

FIELD OF THE INVENTION

The present invention relates to tuning systems and components thereof for stringed instruments such as guitars.

BACKGROUND OF THE INVENTION

Inventors have expended great efforts over the years in their attempts to obtain an optimal tuning system for use with stringed musical instruments, such as guitars. These efforts are indicative of the need for improvement in this field.

Standard guitars typically include six strings corresponding to the musical notes E, A, D, G, B, and E. Guitar strings are placed under tension and extend at a certain height above the guitar body including the neck and a fretboard mounted on the neck. In order to produce the sounds associated with musical notes, the strings are placed in contact with two critical contact points. The first critical contact point is generally at the nut of the instrument, which is usually arranged on the guitar neck adjacent to the first fret of the fretboard. The second critical contact point is generally at the bridge of the instrument which is provided on an opposing end of the fretboard on the body of the instrument. The strings are fixed at a distance beyond the critical contact points at the nut and the bridge.

As is known to those skilled in the stringed instrument art, the sound produced by the strings is affected by the harmonic length (i.e., the distance between where the strings contact the critical contact points at the nut and the bridge). Harmonic tuning of the strings is accomplished by adjusting the distance between the critical contact points at the bridge and nut on the guitar.

The tension of the strings is a second factor which significantly affects the tone. String tension may be adjusted by tightening or loosening the string at the nut or bridge end of the guitar. Adjustment of the tension in the strings affects the pitch thereof and this is commonly known as pitch tuning.

The process of pitch tuning is not very difficult and may be performed by guitar players who have a reasonable ear for the proper pitch associated with various notes. However, harmonic tuning has heretofore been a difficult and time consuming process which needs to be done each time the guitar strings are replaced, especially if a new string gage is used. Most guitar players do not have the ability to harmonically tune their guitars and have therefore previously been forced to hire a professional to perform harmonic tuning operations.

Prior art tuning systems required each string of a guitar to be independently pitch and harmonically tuned by adjusting individual tension control elements and separately adjusting the distance between the critical contact points at the nut and the bridge. Proper harmonic and pitch tuning is obtained when strings ultimately reach a tuned state after many individual adjustments of separate tensioning and distance modifying controls.

The difficulty in tuning prior art guitars is caused, in part, by the structure of various components of the tuning systems. These components may include a nut, tuning pegs or string holders for retaining one end of the strings adjacent to the nut, the bridge including critical contact points and saddles, or other string holding devices arranged to retain an end of the strings in the vicinity of the bridge critical contact points. The strings used in prior art guitars have also contributed to the difficulty in bringing them into a proper tuned state (i.e., a convergence state where the string is both pitch and harmonically tuned).

Tremolos are well-known devices that are typically used with electric guitars to simultaneously and significantly either reduce or increase the tension of the guitar strings of the guitar so that a desired sound effect variation is obtained. Significant improvements in tremolo devices are disclosed in U.S. Pat. Nos. 4,171,661; 4,967,631; 4,497,236; and 4,882,967, all of which have been issued to Floyd D. Rose, the inventor of the present invention. Use of prior art tremolos often contributes to causing strings to go out of tune due to movement of the strings with respect to the critical contact points.

An effort to simplify the tuning process is disclosed in U.S. Pat. No. 4,696,218. This patent teaches the use of strings having a ball affixed at a first end which is sold to the guitar user, who then fixes a ball to a second position on the string at an estimated desired position. This patent also discloses a lever to which the string having a ball at one end is affixed. The lever is pivotable from a first position at which the string is relaxed to a second position at which the string is placed under tension.

U.S. Pat. No. 4,608,904 discloses a string having a ball affixed to each end thereof. There is no disclosure in the '904 patent regarding criticality of the string length. The strings are affixed to a string holding device beyond the nut critical contact points at one end and is affixed to slidable saddle members at a second end beyond corresponding bridge critical contact points. The length of the string between the location where it is secured in the saddle member and the bridge critical contact point is relatively long. This long distance contributes to the associated strings going out of tune easily.

An effort to shorten the vibration length between a termination point at which one end of a string is retained and a critical contact point was made by the inventor of U.S. Pat. No. 4,366,740. The '740 patent discloses a bullet that is secured to a string at one end thereof. This reference teaches that substantial force should be applied between the bullet and the member in which it is captured.

The prior art fails to teach various aspects of the present invention which greatly simplify tuning procedures and replacement of strings. In particular, the prior art does not disclose a string for use in a guitar, or a set of guitar strings, which is precut to a particular length which results in convergence to the harmonic length when the string is pulled to its proper pitch. To this end, the prior art also fails to disclose a method of manufacturing strings for use with a guitar wherein a precise length corresponding to a convergence length at which harmonic and pitch tuning is simultaneously obtained is determined prior to cutting of the string to a precise corresponding length.

Further, the prior art does not teach using a string having a bullet arranged at each end thereof wherein the string exists the bullet as a single strand and remains unencumbered along the entire length between the bullets.

The prior art has also failed to disclose a tuning system which quickly and easily accomplishes simultaneous pitch and harmonic tuning. There is also no disclosure in prior art guitars of a device which automatically urges a string having an anchor thereon along the longitudinal axis of the string so that the string is retained in a secured position.

SUMMARY AND OBJECTS OF THE INVENTION

The present invention overcomes the shortcomings of the aforementioned prior art tuning systems by providing an improved tuning system which permits a guitar player to quickly and easily accomplish simultaneous pitch and harmonic tuning of a guitar. Additionally, the present invention provides improved strings for use with stringed instruments, such as guitars, which allow for a more rapid and simple replacement of guitar strings. Further, the present invention overcomes the shortcomings of the prior art by providing a tuning system in which the strings will remain in tune for a significantly longer period of time than strings used in prior art systems.

Various aspects of the embodiment of the present invention discussed below provide a tuning system which facilitates simultaneous pitch and harmonic tuning by using a single adjustment mechanism. Accordingly, it is an object of the present invention to provide a stringed instrument which can be harmonically and pitch tuned by an average guitar player without requiring the assistance of a professional for such tuning procedure.

Another object of the present invention to provide one or more strings which can be easily installed and removed from the guitar or other stringed instrument. It is another object of the present invention to provide a tuning system which permits tuning of associated strings to be accomplished more easily than has previously been possible.

It is still another object of the present invention to provide a stringed instrument which stays in tune for a greater period of time than prior art instruments.

It is still another object of the present invention in which all of the strings of an associated instrument can be simultaneously tuned. It is still another object of the present invention to provide a tremolo having various advantageous features.

One aspect of the present invention is directed toward one or more strings for use with stringed musical instruments such as guitars. A string having the features of this aspect of the present invention has a predetermined length which is selected to correspond with the convergence length at which harmonic and pitch tuning may be simultaneously obtained. The term "convergence" as used herein refers to the substantially simultaneous occurrence of harmonic and pitch tuning of one or more strings for a guitar or other stringed instruments. This means that the string will simultaneously be harmonically tuned and pitch tuned upon performing a single adjustment which concurrently affects the string tension and the distance between a pair of critical contact surfaces on the associated instrument. Further, the term "critical contact surface" is intended to designate the contact points on an instrument at which the strings are supported and between which the strings vibrate at a certain frequency so that a desired tone is obtained. The critical contact points typically exist at the nut and bridge of the string so that the distance between corresponding critical contact points at the nut and the bridge define the harmonic length of an associated string.

The string may comprise a first anchor affixed to the first end of the string and a second anchor affixed to the second end of the string. As used herein, the term "anchor" is intended to cover various types of objects which may be secured to one or both ends of an associated string for the purpose of facilitating fixation of the string with respect to the body of the guitar. In a preferred embodiment, the anchor elements that are fixed to the ends of the string are bullet-shaped. The bullet-shaped anchor elements will be referred to herein as "bullets". In other embodiments, the anchor elements may comprise balls, blocks, pegs, and may be arranged in other shapes and various sizes.

The term "convergence length" as used herein will be considered the length of a string that is equal to the distance between the nut and the bridge critical contact surfaces plus an additional distance required to permit tuning of the guitar in such a manner so as to simultaneously obtain harmonic and pitch tuning.

In a preferred embodiment, the convergence length of a string comprises a length which is not greater than the distance between the nut and the bridge critical contact surfaces plus approximately one inch±¾ inch. In another preferred embodiment, the convergence length of the string is equal to the distance between the nut and bridge critical contact surfaces plus approximately 0.350 inch±a quarter inch. In a preferred embodiment where an anchor element is affixed to each end of a string, the convergence string length is the length of the string which extends between the two anchor elements, not including any string that may be arranged within the anchor elements or the length of the anchor element itself.

The present invention also includes a set of strings for a stringed instrument, such as a guitar. The set of strings may include one or more strings. When the set includes a plurality of strings, all of the strings may have the same predetermined length. Alternatively, certain of the strings of the set may have a predetermined length that is different from the predetermined length of other strings of the set. The predetermined length of each of the strings is preferably no greater than the distance between the critical contact surface at the nut and the corresponding critical contact surface at the bridge plus approximately two inches±one inch. More preferably, the predetermined length is no greater than the distance between the critical contact surface at the nut and the corresponding critical contact surface at the bridge plus approximately one inch±¾ inch. Still more preferably, the predetermined length of each of the strings is greater than the distance between the critical contact surfaces at the nut and the bridge by approximately one half inch±a quarter inch, and even more preferably 0.350 inch±a quarter inch. Each of the predetermined lengths preferably corresponds to a tuned harmonic length upon placement of the set of strings in assembled position across the corresponding nut and bridge critical contact surfaces on an associated stringed instrument.

When the associated stringed instrument is a guitar, the set of strings may include six strings which correspond to the musical notes E, A, D, G, B and E respectively. It is preferable for each of the predetermined lengths of the strings to be equal to the distance between the nut critical contact surface and its corresponding bridge critical contact surface plus approximately 0.350 inch±a quarter inch.

In another embodiment, a set of strings is provided which includes a plurality of strings wherein at least certain of the plurality of strings have a different predetermined length and the predetermined lengths are selected to correspond with a convergence length at which harmonic and pitch tuning of the corresponding strings are simultaneously obtained. The convergence length may vary depending upon the particular type of instrument used and the components of the tuning system associated with the instruments.

In accordance with another aspect of the present invention, a method of determining the length of the string to be manufactured for use with a stringed instrument is provided. A preferred method comprises the steps of placing a string in contact with the effective nut and bridge critical contact surfaces of an associated instrument. The effective surfaces may comprise actual nut and bridge critical contact surfaces on a guitar, or may comprise simulated nut and bridge critical contact surfaces in a laboratory or a manufacturing environment. The method of the present invention also comprises tuning the string after it is placed in contact with the nut and bridge contact surfaces. The length between the nut and bridge critical contact surfaces is determined while the string is in a tuned condition, and a compensation length which represents a combined desired total distance beyond the nut and bridge contact surfaces, is added so that an overall convergence length is provided at which simultaneous harmonic and pitch tuning of the string can be obtained when the string is arranged in an assembled position on a stringed instrument.

Preferably, the step of tuning the string comprises simultaneously performing pitch and harmonic tuning. In another embodiment, the step of tuning the string may comprise separately performing pitch and harmonic tuning.

When using the aforementioned method of determining the length of the strings to be manufactured, the step of determining the compensation length may comprise ascertaining the length of string required to be placed within anchor elements, such as bullets, at the first and second end of an associated string. When anchor elements are to be fixed to the ends of a string, the step of determining the compensation length also comprises ascertaining the distance between the location where the string will exit the anchor elements at the first end and the bridge critical contact surface, and the distance between the location where the string will exit the anchor element at the second end and the nut critical contact surface.

The present invention also provides a method of manufacturing strings for use with stringed instruments. This method comprises the steps of determining the length of strings to be manufactured as discussed above and thereafter cutting the strings at a location which corresponds to the determined convergence length. The strings are preferably arranged in a relaxed state when performing the cutting step.

The present invention also contemplates providing a stringed instrument, such as a guitar, which comprises a body and a neck having a fretboard mounted thereon. The instrument also comprises a bridge which includes a plurality of bridge critical contact surfaces where the bridge is arranged on the body at one end of the fretboard. A nut is arranged on the neck of the instrument at an opposing end of the fretboard spaced from the bridge. The instrument includes a plurality of strings each having a first end and a second end and a predetermined length which extends between the first and second ends. The strings extend across and are in contact with the corresponding nut and bridge critical contact surfaces. Each of the strings are anchored at a location wherein the first end is preferably spaced from the corresponding bridge critical contact surface by no greater than approximately one inch±a half inch. More preferably, the first end of the string is not more than a half inch±a quarter inch from the bridge critical contact surface. Even more preferably, the first end of the string is no greater than a quarter inch±0.125 inch from the bridge critical contact surface. It is even more preferable for the first end of the string to be no greater than 0.175 inch±0.125 inch from the bridge critical contact surface. The second end of the string is preferably spaced from the nut by the same distances as those recited above between the first end of the string and the bridge critical contact surface. The stringed instrument preferably, but not necessarily, comprises a guitar.

It is preferable for the stringed instrument of the present invention to include an anchor affixed to either the first or second ends of corresponding strings. In another embodiment, the strings associated with the instrument include anchors affixed to both the first and second ends thereof.

The bridge of the associated instrument may comprise a plurality of saddles which are adapted to receive one end of a corresponding one of the plurality of strings. Preferably, the saddles receive and retain an anchor element fixed to one of the ends of the corresponding strings. As used herein, the term "saddle" is intended to comprise a string securing member having a cavity or other retaining device, for retaining one end of the strings at the bridge area of an associated instrument. When the term "bridge" is used with respect to the present invention, it is intended to include an entire bridge assembly which may comprise one or more bridge critical contact surfaces, one or more saddles, and a tuning mechanism arranged in conjunction with the bridge. In certain embodiments, the bridge may comprise a tremolo. Thus, the term "bridge critical contact surfaces" refers to a particular location on the bridge at which the strings of an associated instrument are to be placed in contact so that proper sound tones may be produced.

In one embodiment, the plurality of bridge critical contact surfaces are spaced no greater than approximately one half inch from corresponding ones of the plurality of saddles. In such an embodiment, the distance between the bridge critical contact surfaces and the corresponding saddles is determined from an end surface, such as a shoulder within the saddle cavity.

In an embodiment of the present invention wherein the anchor elements arranged at the ends of associated strings comprise bullets, the location where the string exits the bullets at either end is considered a termination point. It is preferable for a first termination point to be spaced from a corresponding one of the bridge critical contact surfaces by no greater than approximately one inch±a half inch and for a second termination point to be spaced from a critical contact surface at the nut by no greater than approximately one inch±a half inch. In a further preferred embodiment, the distance between the first termination point and a corresponding one of the bridge critical contact surfaces is no greater than approximately one half inch±one quarter inch, and the second termination point is preferably spaced from the critical contact surface at the nut by no greater than approximately one half inch±one quarter inch. In an even more preferred embodiment, the distance between the first termination point and the corresponding bridge critical contact surface is no greater than approximately one quarter inch±0.125 inch, while the second termination point may be spaced from the corresponding nut critical contact surface by approximately one quarter inch±0.125 inch. In an even more preferred embodiment, the distance between the first termination point and a corresponding bridge critical contact surface is no greater than approximately 0.175 inch±0.125 inch, and the distance between the second termination point and the corresponding nut critical contact surface is also approximately 0.175 inch±0.125 inch.

An important aspect of the present invention concerns a stringed instrument which permits convergence tuning to take place. According to this aspect of the present invention, a stringed instrument is provided which comprises a body, a neck attached to the body, a fretboard provided on the body, a nut arranged on the neck at one end of the fretboard, a bridge which includes a plurality of bridge critical contact surfaces arranged on the body at an opposing end of the fretboard from the nut wherein the bridge critical contact surfaces are arranged at a selectively adjustable distance from the corresponding nut critical contact surfaces. The stringed instrument also comprises a plurality of strings, each of which has a first end and a second end and a predetermined length extending between the first and second ends. The plurality of strings are arranged in contact with corresponding bridge critical contact surfaces and nut critical contact surfaces. The strings are placed under tension to permit obtaining of desired musical notes upon strumming or plucking thereof. The stringed instrument also comprises convergence tuning means for simultaneously performing pitch and harmonic tuning of selected ones of the plurality of strings by selectively increasing or decreasing tension in the plurality of strings while simultaneously increasing or decreasing the distance between corresponding bridge critical contact surfaces and critical contact surfaces at the nut.

In a preferred embodiment, convergence tuning means is operatively associated with the bridge whereby selective adjustment of the convergence tuning means causes pivotable movement of the bridge critical contact surfaces toward or away from the nut. Alternatively, adjustment of the convergence tuning means may cause the bridge critical contact surfaces to slide toward or away from the nut. The bridge preferable comprises a plurality of saddles and each of the plurality of strings includes an anchor arranged at both ends thereof. The anchors, which may comprise elongate bullets, are preferably mounted in corresponding ones of the plurality of saddles. The plurality of bridge critical contact surfaces are associated with corresponding ones of the plurality of saddles and are preferably closely spaced to an end surface of the cavity area of the saddles.

The stringed instrument of the present invention preferably comprises a string holder assembly mounted on the neck adjacent the nut for retaining the second end of the plurality of strings. The nut may be secured to the string holder assembly. In a preferred embodiment, the nut, including the nut critical contact surfaces, may be secured to the string holder assembly by screws, or may be otherwise releasably mounted to the string holder assembly. In still another embodiment, the nut may be permanently secured to the string holder assembly, or it may be mounted in abutment with the string holder assembly separately on the guitar body.

It is preferable for the convergence tuning means to comprise a plurality of adjustable knobs wherein each of the adjustable knobs is operatively associated with a corresponding one of the plurality of saddles whereby adjustment of selected ones of the plurality of adjustable knobs causes pivotable movement of corresponding ones of the plurality of saddles so that corresponding bridge critical contact surfaces are pivoted toward or away from the nut. The term "adjustable knobs" as used herein is intended to include various adjustment devices for causing movement of the saddles and the bridge critical contact surfaces. Thus, the term adjustable knobs is intended to include rotatable knobs, slidable adjustment mechanisms, and various other types of adjustment mechanisms. In another preferred embodiment, the bridge comprises a base fixed to the body wherein the plurality of saddles are pivotally connected to the base. The bridge critical contact surfaces are arranged in association with the plurality of saddles and thus may be selectively pivoted with the plurality of saddles.

In a further preferred embodiment, the bridge comprises a plurality of lever arms which are also pivotally connected to the base. The base may include a plurality of threaded passageways. In this preferred embodiment, each of the adjustable knobs may have a threaded shaft which is adapted to extend through corresponding threaded passageways within the base. The saddles are arranged in connection with corresponding lever arms which are arranged for operative association with corresponding adjustable knobs upon threaded movement of the adjustable knobs along the threaded passageways within the base whereby pivoting of corresponding lever arms causes pivoting of the saddles and associated bridge critical contact surfaces.

In a particularly preferred embodiment, the adjustable knobs are arranged so that only a single knob is associated with each one of the plurality of strings whereby adjustment of one of the adjustable knobs obtains simultaneous pitch and harmonic tuning for a corresponding one of the strings.

The bridge in accordance with the present invention may comprise a tremolo for rapidly modifying the tension of associated strings when playing an instrument so that a desired musical effect may be obtained. The tremolo may comprise a conventional tremolo or a tremolo having novel features which will be discussed further below.

The stringed instrument of the present invention may comprise anchor retention means for retaining anchor elements within corresponding ones of the plurality of saddles. The anchor retention means may comprise a retaining wall within the saddle cavity. The stringed instrument of the present invention may also comprise anchor retention means associated with a string holder assembly. The anchor retention means may comprise a wall within cavities of the string holder assembly for preventing movement of anchor elements on the string past the wall. The anchor retention means may also comprise automatic biasing means for automatically urging anchor elements against a retaining wall, substantially along the longitudinal axis of an associated string.

In another embodiment of the present invention, the bridge critical contact surfaces may comprise the top surfaces of corresponding rotatable pegs. The top surface of the rotatable pegs may have a groove for receiving corresponding ones of the plurality of strings when the strings are placed in contact with the plurality of bridge critical contact surfaces.

The top surface of the rotatable pegs preferably includes a raised section. In this embodiment, the bridge critical contact surfaces are arranged only on the raised section. Further, it is preferable for the groove to be arranged on the raised section adjacent the bridge critical contact surface so that an associated string may be properly retained on the bridge critical contact surface during playing of the musical instrument. The plurality of rotatable pegs are preferably rotatable at a location spaced from the cavities of associated saddles. The bridge critical contact surfaces can thus be moved between a first position where they are relatively close to the associated end of a corresponding string and a second position at which they are further from the end of the associated string. Movement of a rotatable peg from its first position to its second position thus changes the harmonic length of the associated string.

The stringed instrument of the present invention also preferably comprises a vertical height adjustment means for adjusting the vertical height position of the plurality of bridge critical contact surfaces with respect to the fretboard. The vertical height adjustment means may comprise a combination of a threaded passageway extending through each of the saddles and a corresponding threaded screw which has a top end and a bottom end arranged for threaded movement along its corresponding threaded passageway. Each of the threaded screws extend through the corresponding threaded passageway so that the bottom end is in contact with a surface below the corresponding saddle whereby adjustment of the threaded screws cause corresponding ones of the plurality of saddles to pivot so that the corresponding bridge critical contact surface moves upwardly or downwardly with respect to the fretboard.

The use of vertical height adjustment means in connection with the present invention obtains three-way convergence including the convergence of harmonic tuning, pitch tuning and the height of the string with respect to the fretboard.

According to another aspect of the present invention, means for obtaining convergence tuning of all of the plurality of strings at the same time is provided. As noted above, convergence tuning pertains to obtaining of simultaneous pitch and harmonic tuning of one or more strings. The means for obtaining convergence tuning is part of the tuning means of the present invention. Preferably, the tuning means comprises means for pivoting the entire bridge between a playing position at which the associated plurality of strings are placed under tension and a loading position at which the entire bridge is tilted toward the nut and the tension in the plurality of strings is simultaneously reduced. When the bridge comprises a tremolo, the means for obtaining simultaneous pitch and harmonic tuning of all of the strings at the same time may also comprise means for selectively locking the bridge in a loading position. Means may also be provided for selectively releasing the bridge from its loading position so that it may be pivoted away from the nut and placed back into its playing position.

When the bridge associated with the means for obtaining simultaneous pitch and harmonic tuning of all of the strings at the same time does not include a tremolo, it may be desirable for the tuning means to comprise means for selectively locking the bridge in the playing position, and means for selectively releasing the bridge from its playing position so that it can be pivoted toward the nut and placed in a loading position.

In accordance with a further aspect of the present invention, a stringed instrument comprises a body, a neck attached to the body, a fretboard provided on the neck, and a nut arranged on a neck at one end of the fretboard. The instrument also comprises a bridge mounted on the body at an opposing end of the fretboard wherein the bridge includes a plurality of saddles pivotally mounted with respect to the body and a plurality of bridge critical contact surfaces associated with corresponding ones of the plurality of saddles. The bridge critical contact surfaces are arranged at a selectively adjustable distance from the nut. The stringed instrument also comprises a plurality of strings, each of which has a first end and a second end and a predetermined length extending between the first and second ends which are arranged at a variable height above the fretboard. The plurality of strings are preferably placed in contact with and extend across the bridge critical contact surfaces and the nut and are placed under tension to permit obtaining of musical notes upon strumming or plucking thereof. The first end of the plurality of strings may be arranged within a corresponding one of the plurality of saddles. A tuning mechanism may be operatively associated with the plurality of saddles to obtain pivotable adjustment thereof along a predetermined arcuate path. According to this aspect of the present invention, the plurality of bridge critical contact surfaces are normally arranged behind the top dead center of the predetermined arcuate path whereby actuation of the tuning mechanism in a manner which causes at least one of the plurality of saddles and the corresponding bridge critical contact surfaces to move toward said nut will cause the height of corresponding strings to increase with respect to the fretboard. Actuation of the tuning mechanism in a manner which causes at least one of the plurality of saddles and corresponding bridge critical contact surfaces to move away from the nut will cause the height of corresponding strings to decrease with respect to the fretboard.

In accordance with still another aspect of the present invention, the stringed instrument includes a tuning system comprising a nut and a bridge which has tuning means which accomplishes harmonic tuning by pivoting the critical contact point about a shaft. In accordance with this aspect of the present invention, the bridge need not simultaneously perform pitch and harmonic tuning. Further, the tuning means used in accordance with this aspect of the present invention should obtain at least harmonic tuning of the plurality of strings by causing pivotable movement of selected bridge critical contact surfaces to obtain a desired distance between the bridge critical contact surfaces and the nut. The tuning means in accordance with this aspect of the present invention may also be used to obtain pitch tuning of the associated strings.

In another embodiment of the present invention, a stringed instrument is provided which comprises a bridge having pivotable saddles and bridge critical contact surfaces associated with each of the pivotable saddles. Pivotable movement of the saddles may occur about a common shaft to adjust the distance between corresponding bridge critical contact surfaces and an associated nut. The same shaft may be used to permit pivotable movement of the entire bridge with respect to the body of the associated stringed instrument. It is preferable in accordance with this aspect of the present invention for the bridge to include a tremolo to rapidly modify the tension of the plurality of strings during playing of the stringed instrument so that a desired musical tone may be obtained. Ball bearings may be used to facilitate rotating of the bridge about the shaft.

It is also preferable for this aspect of the present invention to comprise vertical height adjustment means for adjusting the height of the bridge critical contact points with respect to the fretboard. The vertical height adjustment means may be mounted on the bridge and is rotatable about the same shaft that is used to permit pivotable movement of the associated saddles.

Another aspect of the present invention is directed toward a stringed instrument, such as a guitar, having the features of the stringed instruments discussed above wherein the stringed instrument also comprises automatic biasing means for automatically urging anchor elements arranged at one or both ends of associated strings substantially along a longitudinal axis of the strings so that the anchor elements are fixed in a secured position at the bridge or the nut.

In a preferred embodiment, the automatic biasing means comprises a first automatic biasing device for automatically urging the anchor element at one end of the string to a secured position at the bridge, and a second automatic biasing device for automatically urging the anchor element affixed to the other end of the string into a secured position at the nut assembly.

The first and second automatic biasing devices preferably comprises a plurality of spring biased ball plungers. The spring biased ball plungers of the first automatic biasing device are arranged at the bridge in abutment against corresponding anchor elements affixed to an associated end of a string. The spring biased ball plungers of the second automatic biasing device are preferably arranged at the nut in abutment against corresponding anchor elements to secure the anchor elements in assembled position at the nut assembly. In a preferred embodiment, the anchor elements comprise elongate bullets.

The automatic biasing means is useful to provide a certain degree of force on anchor elements arranged in saddles at the bridge or string holders at the nut so that the anchor elements will not pop out of the respective saddles or string holders during playing of the instrument or use of a tremolo or any inadvertent relaxation of the string tension. The spring biased ball plungers which are preferably used in accordance with this aspect of the present invention should be able to produce a force sufficient to retain the anchor elements in a secured position during playing, but the force should not be so great as to prevent easy removal of the anchor element when desired to replace the strings of the associated instrument. This aspect of the present invention obviates the need to use wrenches or other tools, to remove or replace strings as is the case in prior art guitars.

Another aspect of the present invention provides a nut assembly including an adjustable string holder which may be used with a stringed instrument, such as the stringed instruments discussed above. The adjustable string holder is preferably used in combination with an adjustable bridge having critical contact points which cooperate in obtaining convergence harmonic and pitch tuning. In this embodiment, the nut critical contact surfaces are preferably fixed with respect to the first fret while the string holders are mounted in association with the nut and are permitted to pivot or slide so as to assist in tuning of the instrument.

Still another aspect of the present invention is directed toward a string having an elongate bullet affixed to both ends thereof. According to this aspect of the present invention, the elongate bullets arranged at the ends of the string are distinguished from other anchor elements such as ball-shaped anchor elements and square anchor elements. Further, each of the strings in accordance with this aspect of the present invention includes a single unencumbered strand at the termination points at which the strings exit the bullets.

The above objects, as well as further objects, features, and advantages of the present invention will be more fully understood with reference to the following detailed description of the present invention when taken in conjunction with the accompanying drawings described below.

DETAILED DESCRIPTION OF THE PREFERRED EMBODIMENTS

Figure 1:
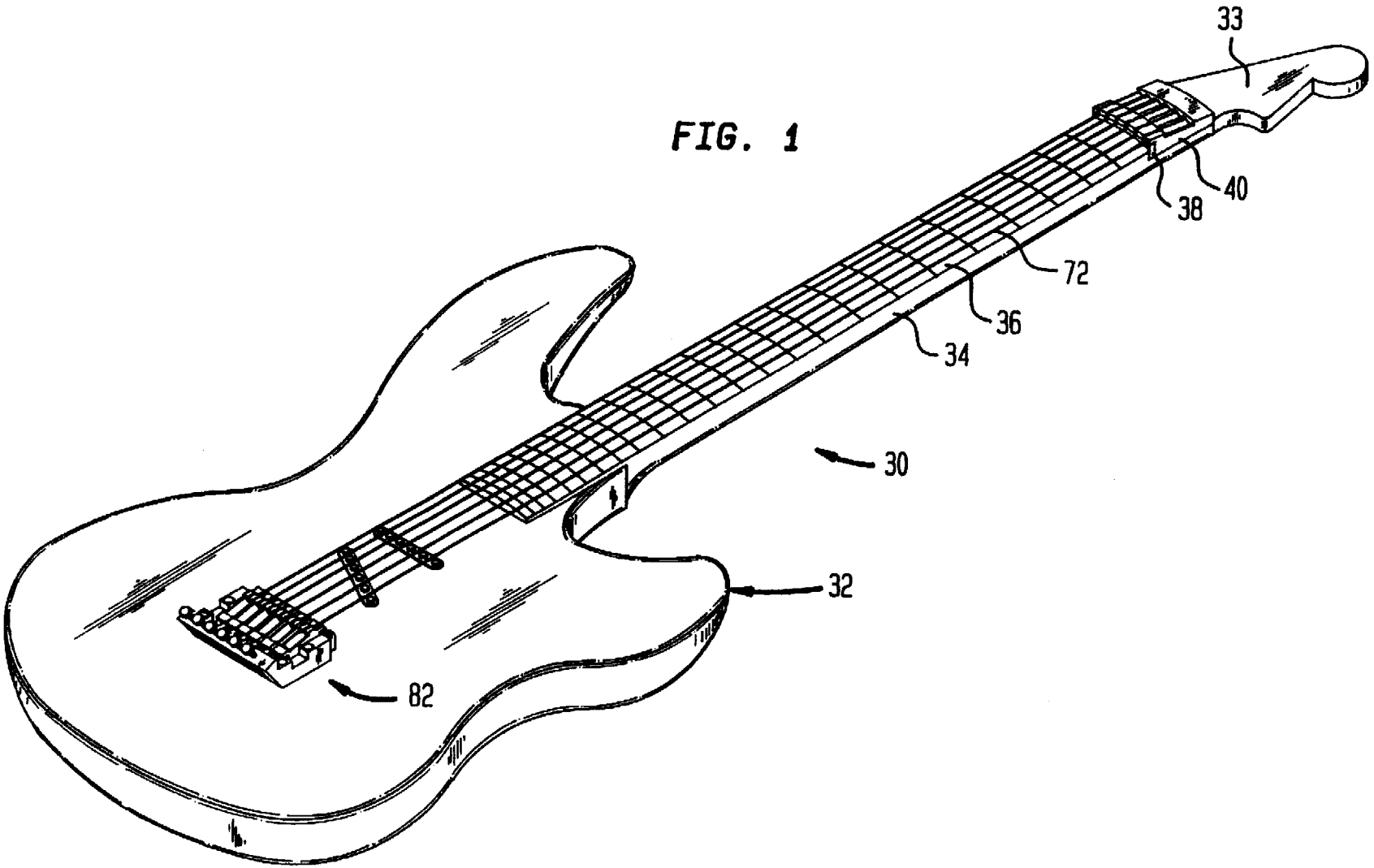
FIG. 1 is a perspective view of a guitar including the tuning system of the present invention.
Figure 2:
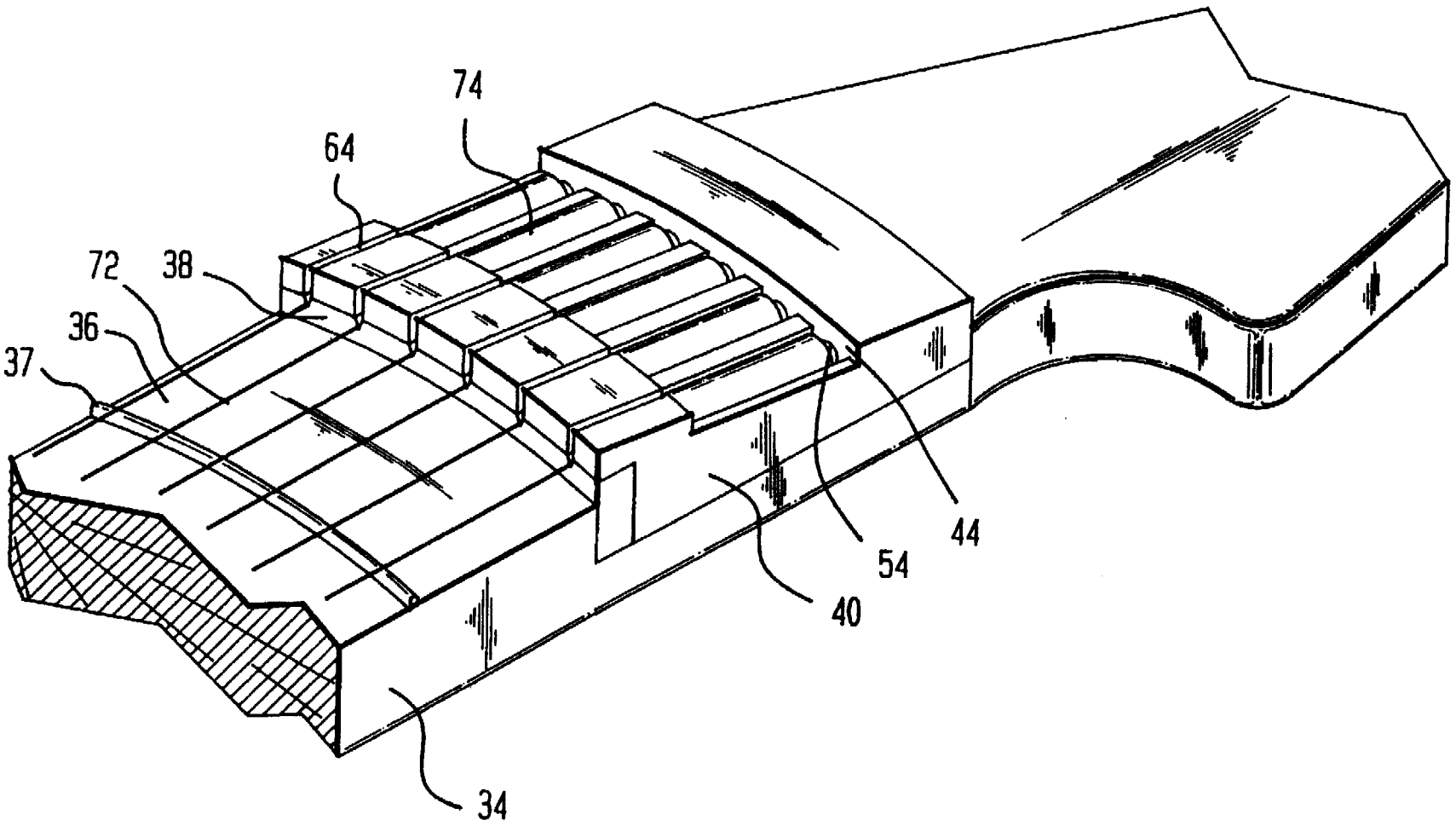
FIG. 2 is an enlarged perspective view of a nut assembly and corresponding strings in accordance with the present invention.

Like reference numerals have been used whenever possible to designate like components in the various embodiments of the present invention. Thus, in certain embodiments various components or features may be designated by different reference numerals while similar components and features will be designated by the same reference numerals.

A guitar 30 including one embodiment of the tuning system of the present invention is shown in FIG. 1. The guitar 30 may be an electric guitar. However, it should be appreciated that the present invention can be used in connection with various stringed instruments such as acoustic guitars, violins, banjoes, and the like wherein the associated strings need to be tuned.

The guitar 30 includes a body 32 and a neck portion 34. A fretboard 36 is arranged on the neck and extends between a first end arranged near the head 33 of the guitar and a second end which extends toward the body 32 of the guitar 30. A plurality of strings 72 are mounted to extend between a nut assembly which includes a string holder 40 and a nut 38, and a bridge assembly generally designated 82. Unlike prior art guitars, the guitar 30 of the present invention does not require tuning pegs on the head 33. As the strings 72 terminate within the string holder 40 of the nut assembly.

Figure 3:
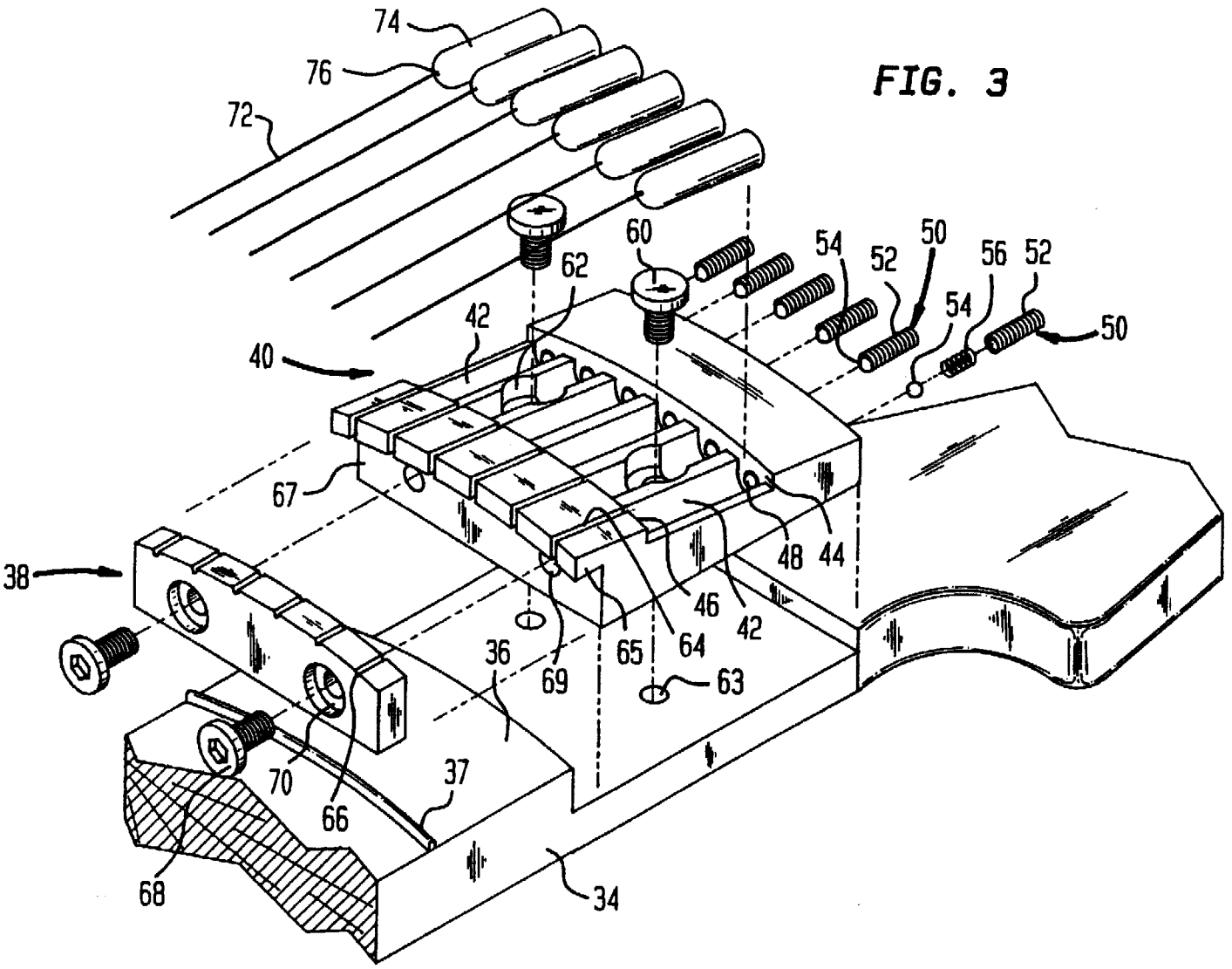
FIG. 3 is an enlarged exploded perspective view of the nut assembly and strings shown in FIG. 2.

As shown in FIGS. 2–5, the string holder 40 and the nut 38 are mounted on the neck 34 of the guitar 30 at one end of the fretboard 36. One novel aspect of the present invention pertains to the mounting position of the string holder 40 and the nut 38 with respect to each other. In particular, as is clearly shown in FIGS. 1–5, the string holder 40 and the nut 38 are arranged in abutment with each other when mounted in assembled position on the guitar neck 34. As illustrated in FIG. 3, the nut 38 is placed adjacent the front wall 67 of the stringholder 40 when in assembled position.

Figure 4:
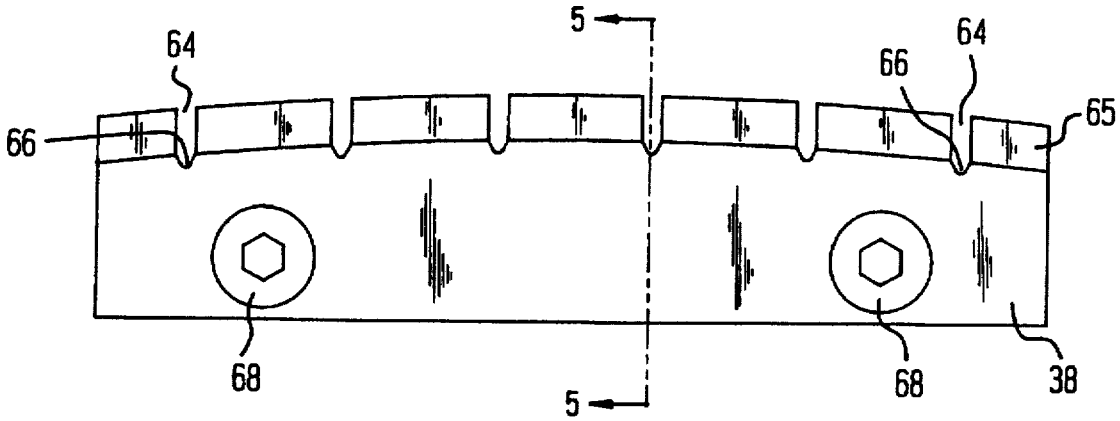
FIG. 4 is a front view of the nut assembly shown in FIG. 2 with the strings removed.
Figure 5:
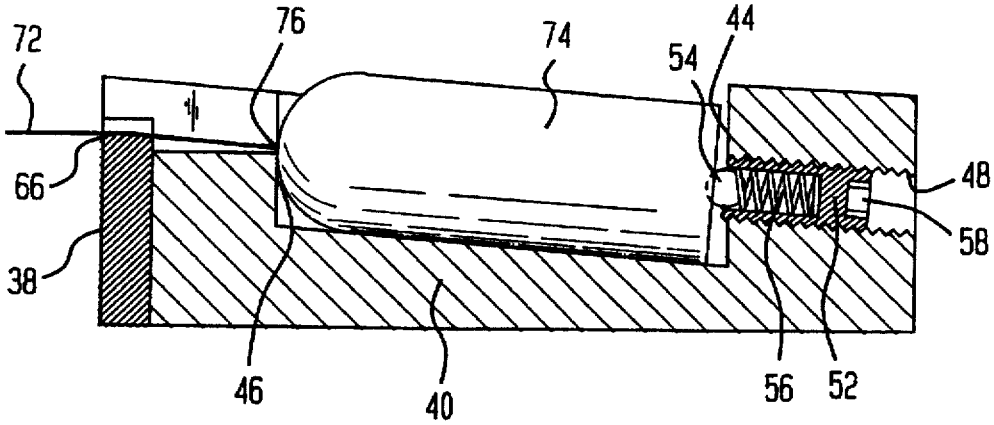
FIG. 5 this a cross-sectional view of the nut assembly and strings shown in FIG. 4 taken along line 5—5 of FIG. 4 and showing a string and associated anchor element in assembled position.

FIGS. 3–5 illustrate that the nut 38 includes a plurality of critical contact surfaces 66 on which a string 72 is supported. It should be appreciated that common terminology in the art refers to "critical contact points" as opposed to "critical contact surfaces" when referring to the locations at the nut and the bridge of a guitar on which the strings are supported. The term "critical contact surfaces" has been used instead of the term "critical contact points" herein as it is believed to more accurately define the location at which the strings 72 contact the nut 38 and the bridge assembly 82. Each of the critical contact surfaces 66 are arranged at the bottom of an associated groove to assure that the string 72 remains in proper position during playing of the guitar 30. The string holder assembly 40 includes a plurality of cavities 42 which have a rear shoulder 44 and a front retaining shoulder 46 defining the cavity length therebetween. As will be discussed in more detail below, the cavities 42 are sized and shaped to retain corresponding anchor elements, shown as bullet-shaped elements 74 that are secured to a first end of the corresponding string 72. The bullet-shaped elements will be referred to simply as "bullets" herein.

A threaded passageway 48 extends between the rear shoulder 44 of the cavity 42 and the back end of the string holder 40. The threaded passageways 48 are sized and shaped to receive corresponding spring biased ball plungers 50. These, or similar, ball plungers have been commercially available prior to the present invention. However, it is believed that they have not heretofore been used as a string retaining member, as in the case of the present invention, or in any other way in connection with the stringed instrument art.

As shown in FIG. 3, the spring biased ball plungers 50 include a threaded tube-like body 52 and a ball detent 54 which may be press-fitted in the front end of the threaded body 52. The ball detent 54 is biased outwardly by a compression spring 56 which is arranged within the threaded body 52 between the ball detent 54 and a rear end of the threaded body. The ball detent 54 would be movable within the cavity of threaded body 52 if the compression spring 56 was not arranged to urge the ball detent 54 outwardly. An adjustment hexagonal shaped socket 58 is fixed to the rear end of the threaded body 54 to permit adjustment of the spring biased ball plunger.

As can be appreciated from FIG. 5, when the spring biased ball plungers 50 are arranged in their assembled position within corresponding threaded passageways 48, the ball detents 54 extend through the rear shoulder 44 and into a corresponding cavity 42. As will be discussed further herein, the function of the spring biased ball plungers 50 is to automatically urge corresponding bullets 74 along the longitudinal axis of associated strings 72 so that the bullets 74 are secured against corresponding front shoulders 46 of the associated cavities 42. This will secure the bullets 74 within the string holder 40 during playing of the associated guitar 30. It should be appreciated that various types of biasing devices, such as leaf springs, other spring biased devices, or other force exerting devices, may be used in place of the spring biased ball plungers 50 while keeping within the scope and spirit of the present invention. The important aspect of this feature of the present invention is simply to provide an automatic biasing device to secure associated bullets in assembled position during playing of the instrument while permitting the bullets 74 to be easily removed from their corresponding cavities 42 in the string holder 40 when a player wishes to change the strings 72.

The string holder 40 may include a pair of recessed bores 62 which are adapted to be aligned with a pair of corresponding threaded passageways 63 within the neck 34 of the guitar 30. A pair of mounting screws 60 extend through the recessed bores 62 in the string holder 40 and the corresponding threaded passageways 63 in the neck 34 of the guitar to secure the string holder 40 into assembled position.

The mounted relationship between the string holder 40 and the nut 38 is such that the distance between the critical contact surfaces 66 on the nut 38 and the forward-most shoulder 46 of corresponding cavities 42 is preferably relatively small. Since the bullets 74 will be urged forward into a secured position against the corresponding shoulder 46, the location where the string 72 exits the bullet 74 will also be arranged adjacent the forward-most shoulder 46 of the cavities 42. This location is considered a termination point herein and designates an effective end of the string 72. Thus, the difference between this effective end of the string 72 and the corresponding critical contact surface 66 is also relatively small. In preferred embodiments, this distance may be between about 0.05 inch and three inches. In a particularly preferred embodiment, this distance may be approximately 0.175 inch.

The nut 38 may be secured to the front wall 67 beneath the overhang 65 of the string holder 40 by placing mounting screws 68 through corresponding recess bores 70 and into aligned threaded passageways 69 at the front end of the string holder 40. This arrangement is shown in FIG. 3.

It is an advantageous feature of the present invention to have the nut 38 including the critical contact surfaces 66 arranged close to, or in abutment termination point 76, where it exits the corresponding with, the string holder 40. This arrangement results in several advantages including minimization of the distance between the effective first end of each string 72, at termination point 76, where it exits the corresponding bullet 74 and the corresponding nut critical contact surface 66.

It is desirable to minimize the distance between the termination point 76 at the effective end of the string 72 and the corresponding critical contact surface 66 on the nut 38 so that the strings may be maintained in a tuned state for a relatively long period of time. In preferred embodiments, this distance may vary between 0.05 inch and three inches. In a particularly preferred embodiment, this distance may be approximately 0.175 inch.

Another advantage that results from securing the nut 38 on the string holder 40 is that the need to separately mount the nut on the guitar neck is obviated. It also results in automatic alignment of the grooves 64 which extend through the overhang 65 and parallel to the center axis of the cavities 42 of the string holder 40 with the grooves adjacent the nut critical contact surfaces 66. As is known in the art, it is desirable for the top surface of the nut 38 to have an arc which generally corresponds with the arc of the first fret 37 of the fretboard 36.

As is shown in FIG. 5, the ball detent 54 of the ball plunger 50 is biased forwardly by the compression spring 56 mounted within the body 52 of the ball plunger 50. The ball detent 54 is arranged to abut the rear end of the an associated bullet 74 whereby the bullet is urged into a secure position against the forward-most shoulder 46 of a corresponding cavity 42.

Figure 6:
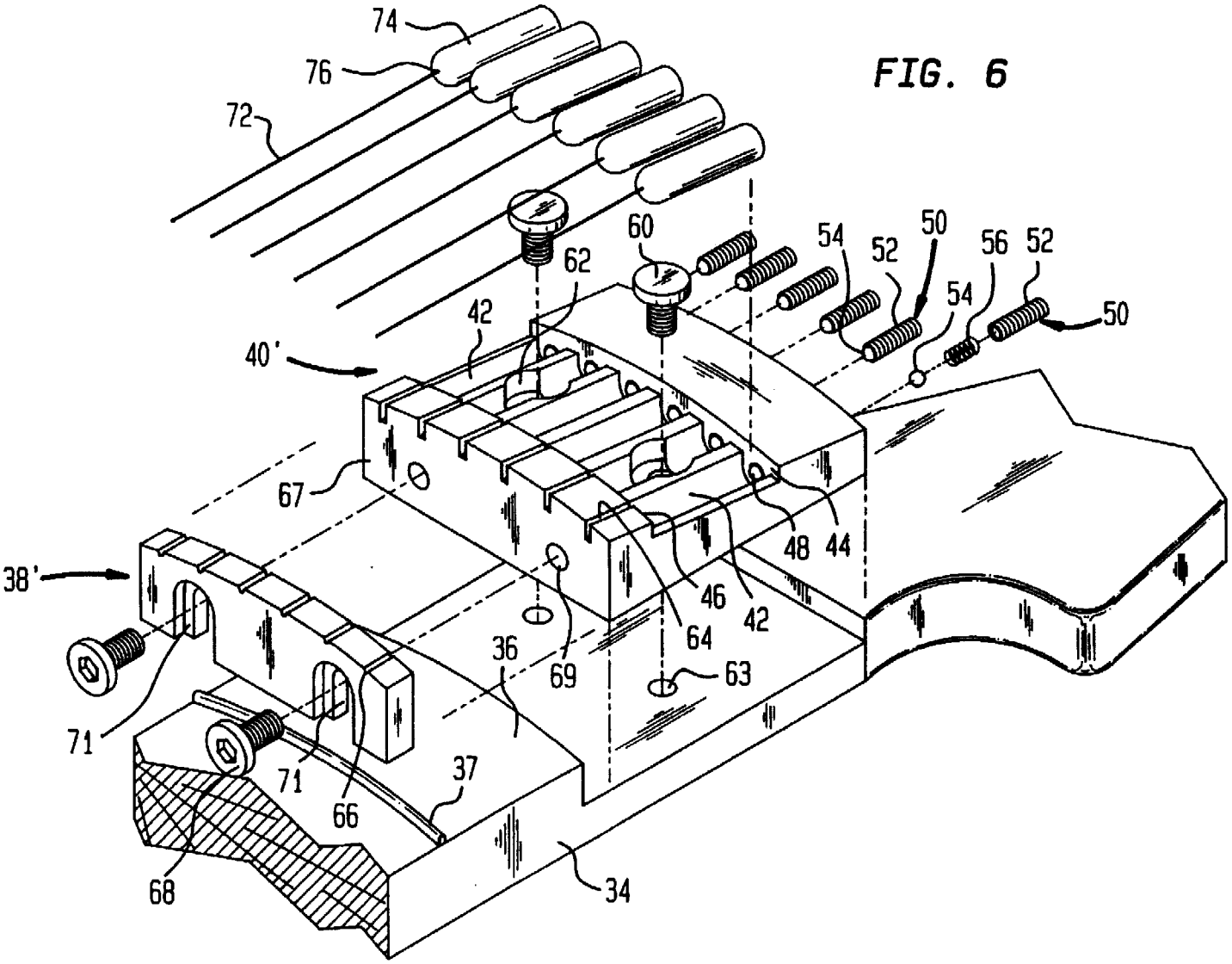
FIG. 6 is an enlarged exploded perspective view of a second embodiment of a nut assembly and corresponding strings in which a portion of the nut assembly is vertically adjustable in accordance with the present invention.

A second embodiment of the nut assembly including a string holder 40' and the nut 38' is shown in FIG. 6. This embodiment can be distinguished from the embodiment shown in FIGS. 2–5 as the overhang section 65 has been removed. Additionally, a pair of adjustment slots 71 are shown in place of the recessed bores 70. FIG. 6 illustrates that the adjustment slots 71 extend vertically from an opened side at the bottom of the nut 38' to a closed end nearer the top of the nut 38'. The resulting structure permits the nut critical contact surfaces 66 to be vertically adjusted upon sliding of the nut 38' to a desired height with respect to the fretboard 36 before the nut 38' is securely tighten against the front wall 67 string of holder 40' by the mounting screws 68. As can be appreciated by FIG. 6, adjustment of the nut 38 along the slots 71 will result in the concurrent vertical height adjustment of each of the plurality of contact surfaces with respect to the fretboard 36.

A bridge 82 is shown in FIGS. 7–12 in accordance with one embodiment of the present invention. As with the nut assembly, the bridge 82 may be used with various stringed instruments including a guitar. When the bridge 82 and the nut assembly including the string holder 40 are used in combination with each other as part of an overall tuning system on the guitar 30, each of the associated strings 72 preferably have bullets 74 and 78 arranged at the respective string ends. As indicated above, the termination point 76 is the location of the string 72 where it exits the bullet 74. This location is considered an effective end of the string. The same arrangement applies to the other end of the string where it exits the bullet 78. This termination point is designated by reference numeral 80 and is also considered an effective end of the string. It should be appreciated that each of the strings 72 may include a certain length arranged within the associated bullets 74 and 78. However, the length of the strings arranged within the bullets is not pertinent with respect to the distance between the effective ends of the strings 72 and the critical contact surfaces 66 at the nut and of the corresponding critical contact surfaces 94 at the bridge 82 which will now be discussed in some detail.

The overall bridge assembly 82 is made of various components including a base 84 with a plurality of individually adjustable saddle structures 86. Each of the saddle structures 86 include a cavity 88 having a shoulder 90 arranged at the end of the cavities 88 closest to the bridge critical contact surfaces 94. Each of the saddles 86 also include a plurality of grooves 92 which preferably extend substantially parallel to the center axis of the corresponding saddle cavities 88. Bridge critical contact surfaces 94 are arranged within corresponding grooves 92. This feature of the present invention is clearly shown in FIG. 9.

The term "bridge" is often used in the art to designate the critical contact points only. These are the points where the guitar strings actually contact corresponding bridge members. It should be appreciated that although the terms "bridge" or "bridge assembly" as used herein include the critical contact surfaces 94 they also include various other components.

The bridge assembly 82 also includes a plurality of lever arms 98 which are associated with respective saddles 86. The lever arms 98 each include a first end at which a platform 100 is arranged for cooperating with respective vertical adjustment screws 106. A second end of the lever arms 98 are operatively associated with the tuning mechanism. An aligned aperture 102 extends through each of the lever arms 98 for receiving a shaft 96 about which the saddles 86 pivot together with corresponding lever arms 98 with respect to the base 84. The lever arms 98 also include a centrally arranged aperture 104 which receives an elongate shaft 112. The rear end of the saddles 86 also include an aperture 105 for receiving the shaft 112 which secures each of the saddles 86 to corresponding lever arms 98. The shaft 96 does not extend through the body of the saddles 86. Instead, it extends through the aligned apertures 102 in the lever arms 98 and is mounted in receiving apertures at opposing sides of the base 84.

A threaded passageway 108 is vertically arranged at the front end of each of the saddles 86 to receive corresponding vertical adjustment screws 106 therein. The threaded passageways 108 extend completely through the respective saddle body so that it may cooperate with the platform 100 arranged therebelow. As will be discussed in more detail herein, the vertical adjustment screws 106 are used to adjust the height of the individual bridge critical contact surface 94 with respect to the fretboard 36. A space 110 is provided between the front end of the saddle body and the corresponding platform 100 which is representative of the relative height of the corresponding bridge critical contact surfaces 94 with respect to the fretboard 36.

Each of the saddle members 86 have longitudinally extending threaded passageways 89 arranged at the rear end thereof extending into corresponding cavities 88. The threaded passageways 89 are sized and shaped to receive corresponding spring biased ball plungers 50 which are used to automatically urge the associated bullet 78 against the shoulder 90 at the front end of the cavity 88 so that the bullet 78 is securely arranged in its assembled position during playing of the associated guitar 30.

The bridge assembly 82 also includes a plurality of tuning knobs 116 having threaded shafts 118 which extend through a corresponding threaded passageway within the rear of the bridge assembly base 84. Each of the threaded shafts 118 are arranged to contact the rear end of a corresponding lever arm 98 as clearly shown in FIGS. 9 and 12. Adjustment of the tuning knobs 116 toward or away from corresponding lever arms 98 will cause associated saddle members 86 and the bridge critical contact surfaces 94 arranged thereon to pivot about the shaft 96. A more detailed description of the operative association between the tuning knobs 116 and the saddle members 86 will be discussed in connection with the use and operation of the present tuning system below.

A plurality of leaf springs 99 arranged in their expanded state between the bottom ledge 101 of the base 84 and the bottom surface of corresponding lever arms 98. This feature of the present invention can be appreciated from the disclosure in FIGS. 9–12, 18 and 19. Each of the leaf springs 99 correspond with one lever arm 98 to urge the lever arm 98 upwardly so that the top surface of the rear end of the corresponding lever arms 98 is constantly abutting corresponding threaded shafts 118 of the tuning knobs 116. It should be appreciated that the lever arms 98 are in the same position due to the tension that is normally exerted on the saddles 86 by corresponding strings 72 and their associated bullets 78. However, when tension in the strings 72 is removed, as may occur during playing of a tremolo, or replacement of the strings 72, the corresponding lever arms 98 would fall downwardly with respect to the corresponding threaded shafts 118 if the corresponding leaf springs 99 were not arranged in assembled position to constantly urge the corresponding lever arms into abutment with the end of the corresponding threaded shafts 118.

Figure 7:
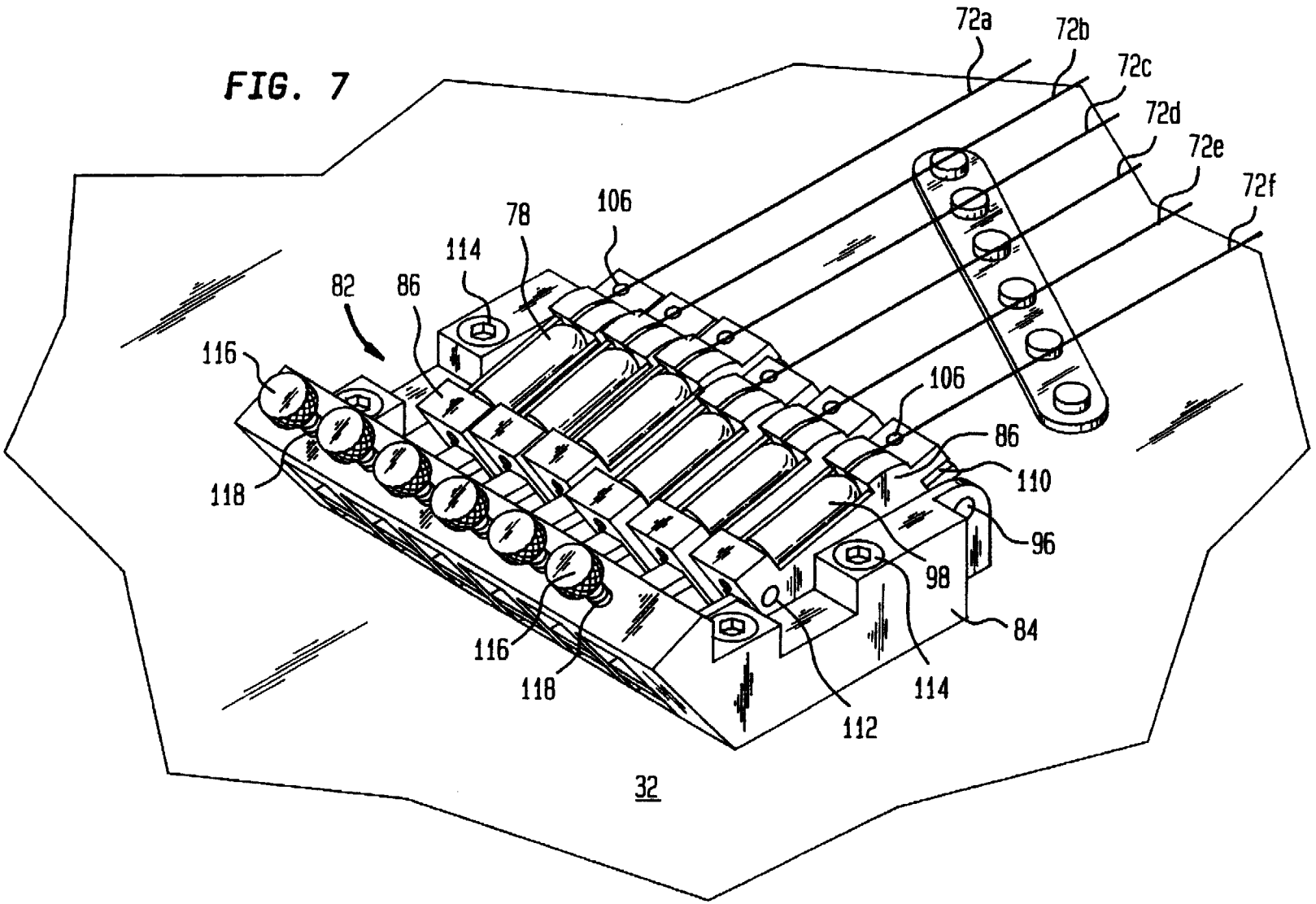
FIG. 7 is an enlarged perspective view of a bridge assembly and corresponding strings in accordance with the present invention.
Figure 8:
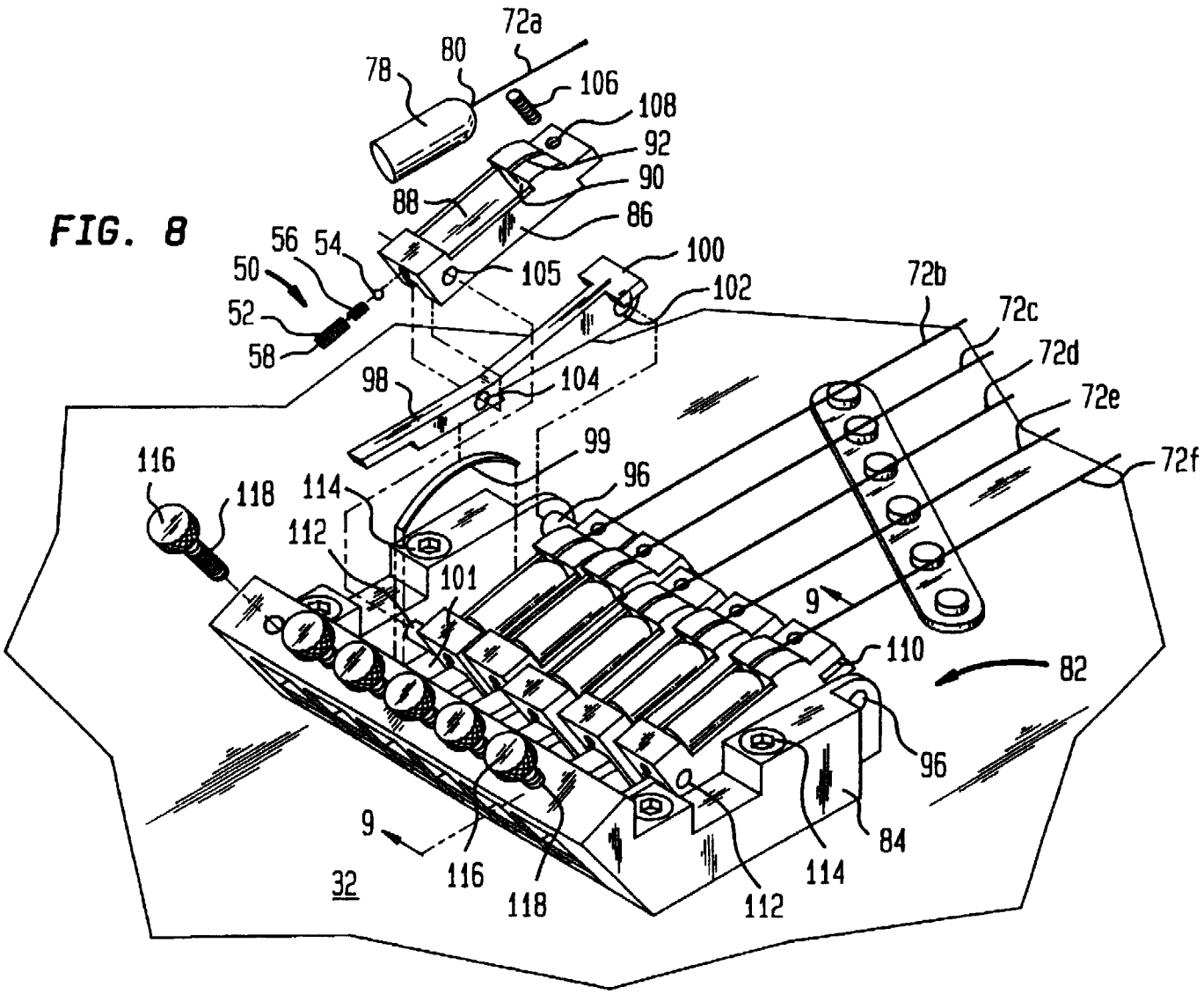
FIG. 8 is a partially exploded view of the bridge assembly shown in FIG. 7.
Figure 9:
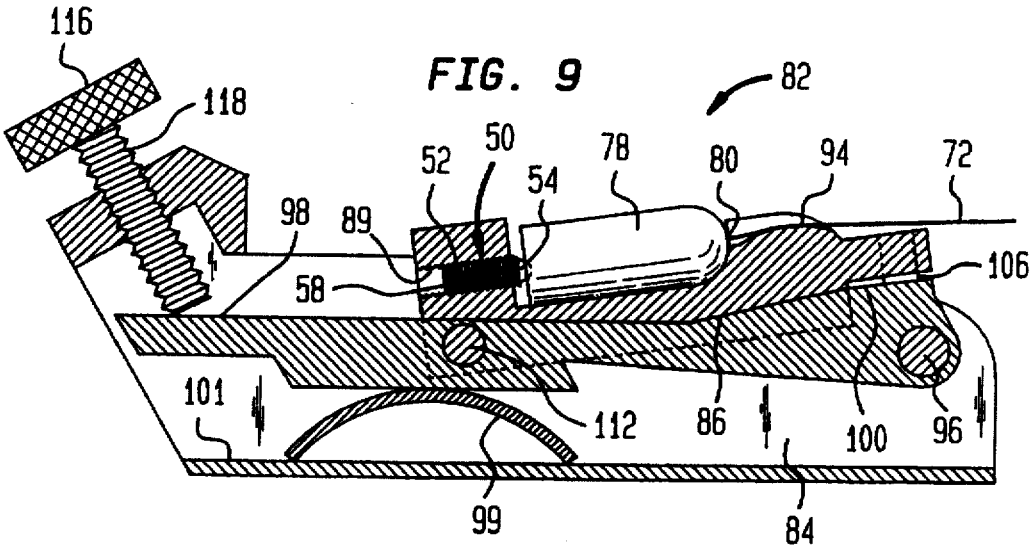
FIG. 9 is a side cross sectional view of the bridge assembly shown in FIGS. 7 and 8 and corresponding strings taken along line 9—9 of FIG. 8.
Figure 10:
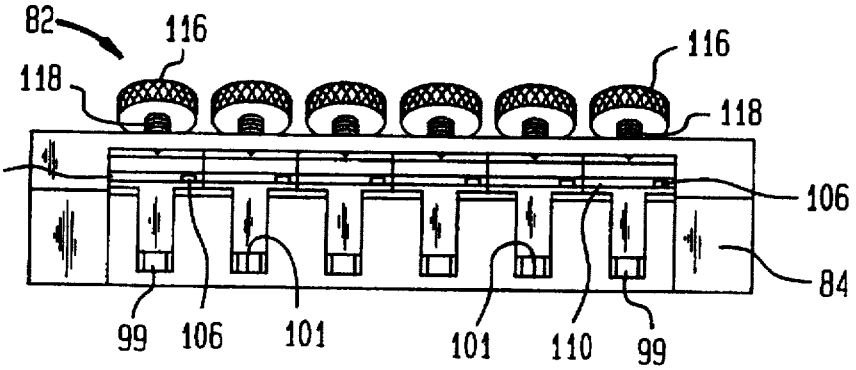
FIG. 10 is a enlarged front view of the bridge assembly shown in FIG. 7.
Figure 11:
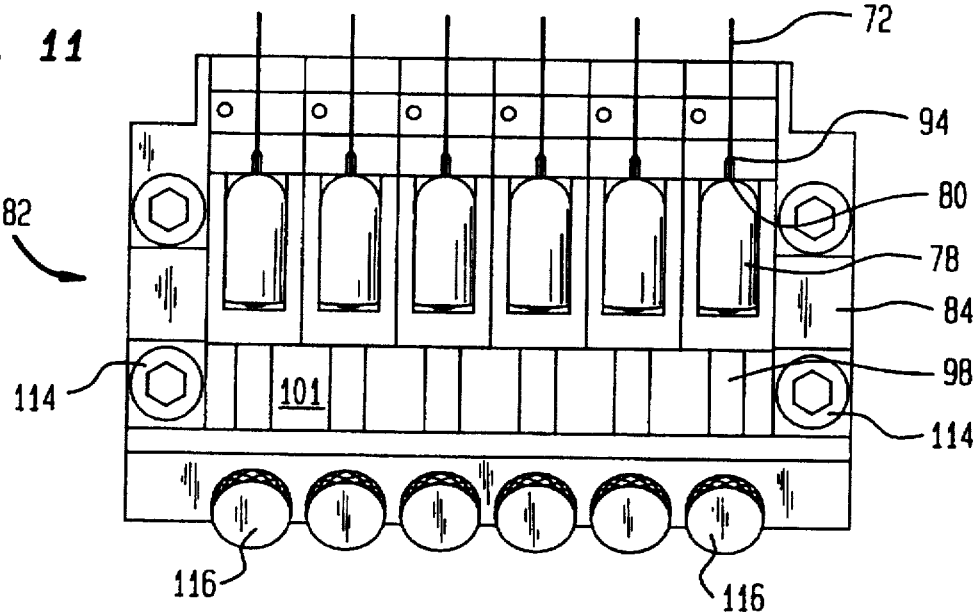
FIG. 11 is an enlarged top plan view of the bridge assembly shown in FIG. 7.
Figure 12:
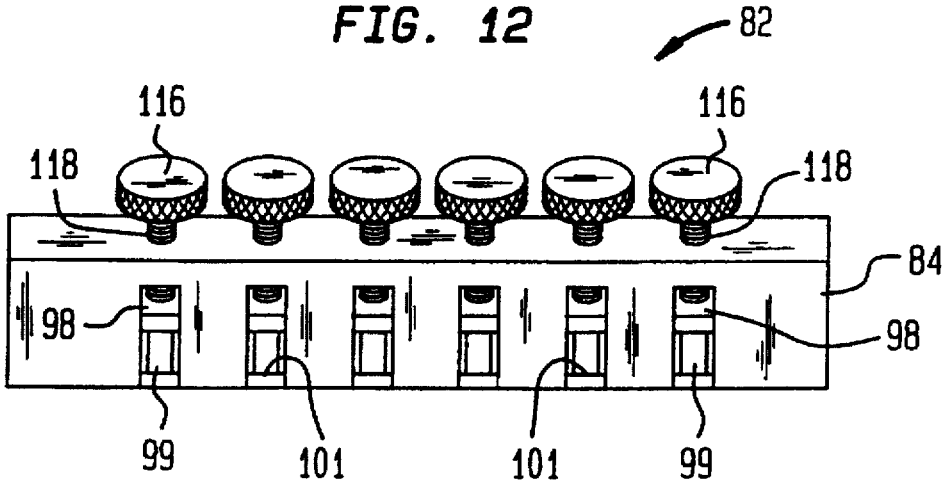
FIG. 12 is an enlarged rear view of the bridge assembly shown in FIG. 7.

As best shown in FIGS. 7, 8 and 11, the base 84 of the bridge 82 is secured to the body 32 of the guitar 30 by a plurality of mounting screws 114. In other embodiments, the bridge assembly may be mounted for rotation with respect to the guitar body 32.

Bridge critical contact surfaces 94 may be pivotally adjusted toward or away from the corresponding nut critical contact surfaces 66. Such pivotable movement occurs about the common shaft 96 which extends through the apertures 102 in each of the lever arms 98. Although the saddles 86 and the corresponding bridge critical contact surfaces 94 are discussed herein as pivotally connected to the base 84 for selective adjustment of the distance between the bridge critical contact surfaces 94 and the nut critical contact surfaces 66, it should be appreciated that in alternate embodiments the saddles 86 can be slidable positioned relative to the nut critical contact surfaces 66. In accordance with the preferred embodiment of the present invention, convergence tuning occurs by simply pivoting the saddle members 86 and the corresponding lever arms 98 about the shaft 96. However, the scope of this aspect of the present invention is intended to cover convergence tuning upon slidable movement of the saddle members 86.

Spring biased ball plungers 50 are also used to retain corresponding bullets 78 at the bridge 82 of the guitar 30. In addition to performing the function of preventing corresponding bullets 74 and 78 from coming out of their secured position within the string holder 40 and the bridge 82, the ball plungers 50 also contribute to the advantageous feature of the present invention in that the strings 72 of the guitar 30 remain in tune for a longer period of time than strings in prior art guitars. This is due to the contribution of the ball plungers 50 toward eliminating string drag which occurs when the relative position of the strings move with respect to the critical contact surfaces at the nut and the bridge during playing of the guitar and when the strings do not completely return to their original position. In many prior art designs, string drag often occurs after a tremolo is used and thus, the strings are left out of tune. The string biased ball plungers 50 work to eliminate the string drag problem by preventing relative movement of the associated string 72 with respect to the nut critical contact surfaces 66 and the critical contact surfaces 94 at the bridge which will be discussed below.

Figure 13:
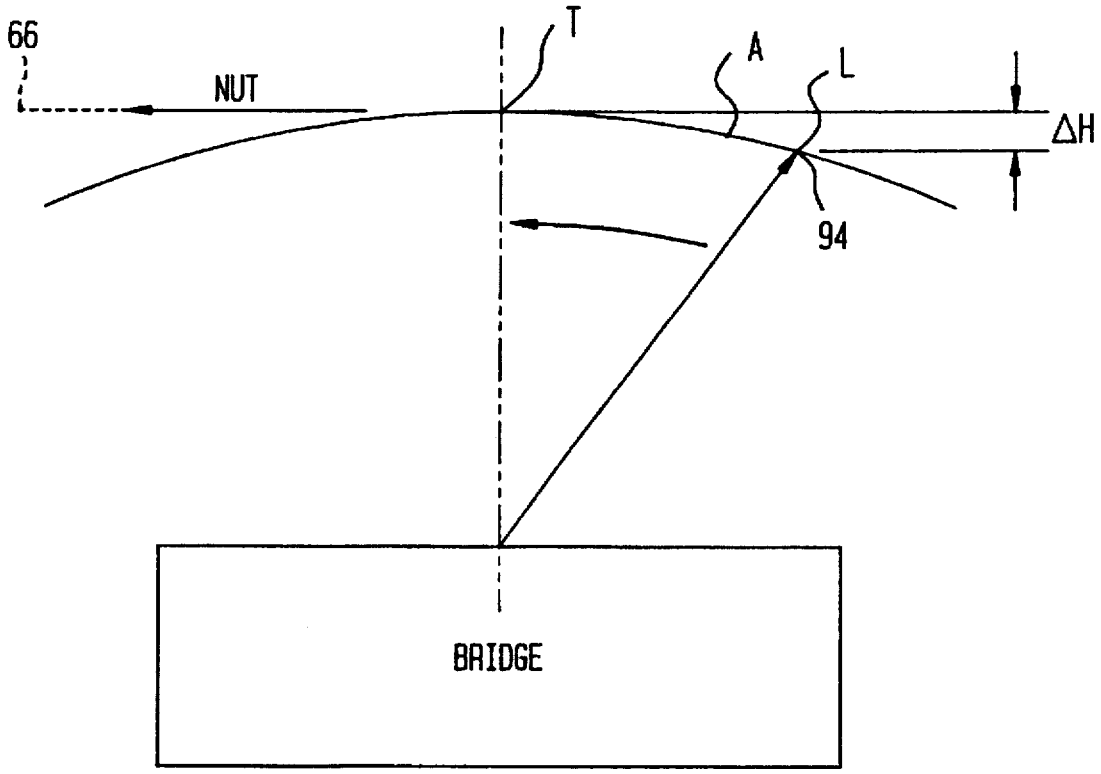
FIG. 13 is a schematic illustration of arcuate movement of bridge critical contact surfaces in accordance with one aspect of the present invention.

In a preferred embodiment, movement of the bridge critical contact surfaces 94 is along an arc so that as the distance between the bridge critical contact surfaces 94 and the corresponding nut critical contact surfaces 66 increases or decreases, the height of the bridge critical contact surfaces 94 with respect to the fretboard 36 slightly increases or decreases. FIG. 13 illustrates the path of movement of the bridge critical contact surfaces 94 in a preferred embodiment of the present invention. As shown therein, a typical location L of one of the bridge critical contact surfaces 94 is behind the top dead center T of its arcuate path relative to the nut critical contact surfaces 66 when the string 72 associated with a particular bridge critical contact surface 94 is in tune. When the bridge critical contact surface 94 is caused to pivot along the arc A toward a corresponding nut critical contact surface 66, the tension in the associated string 72 is lessened so that the pitch associated with that particular string will decrease as the harmonic length between the bridge critical contact surface 94 and the corresponding nut critical contact surface 66 decreases. However, the height of the bridge critical contact point 94 with respect to the fretboard 36 will increase when it is pivoted toward the corresponding nut critical contact surface 66 from its normally tuned position behind top dead center T when the corresponding string 72 is in a tuned state. Similarly, when one of the bridge critical contact surfaces 94 is pivoted away from the corresponding nut critical contact surface 66 the harmonic length and the pitch increases while the height of the associated string 72 with respect to the fretboard 36 decreases. The slight deviation in the height of the string 72 with respect to the fretboard 36 upon pivotal movement of the bridge critical contact points 94 is represented in FIG. 13 by $\Delta H$.

Figure 14:
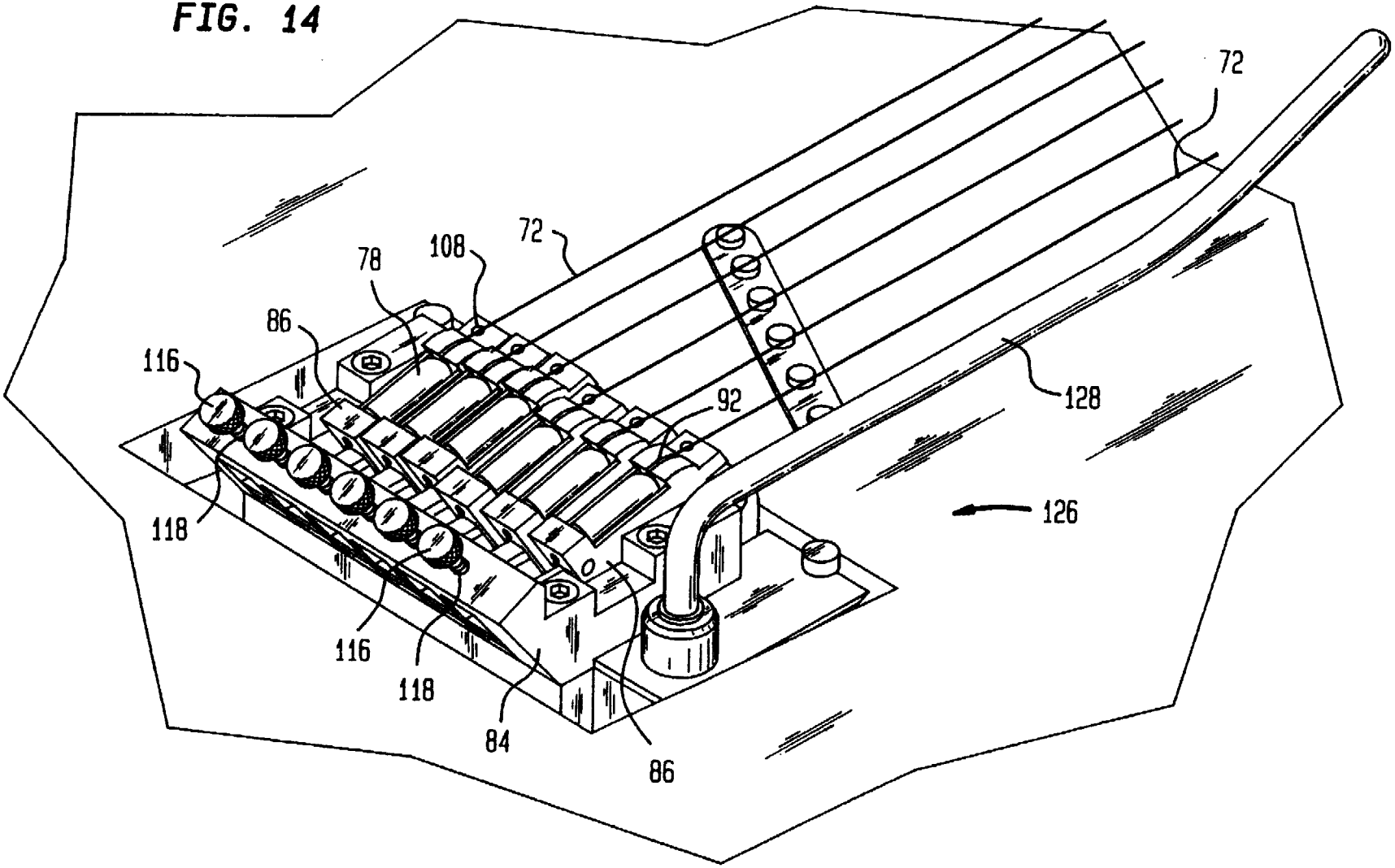
FIG. 14 is an enlarged perspective view of a tremolo bridge assembly in accordance with one aspect of the present invention.

As discussed above, a tremolo may be used when it is desired to obtain unusual tone variations. This occurs when the tension in all of the strings is rapidly increased or decreased during playing of an electric guitar. The features of the bridge assembly 82 discussed above with respect to FIGS. 6–13 may also be used when the bridge comprises a tremolo 126 as illustrated in FIG. 14. The tremolo 126 can be mounted on the body 32 of the guitar 30 in a conventional manner such as that disclosed in U.S. Pat. Nos. 4,171,661; 4,967,631; 4,497,236 and 4,882,967, the disclosures of which are incorporated by reference herein. Additionally, the features of the present tuning system can be used with novel tremolo embodiments, such as those discussed hereinbelow. When it is desired to use the tremolo 126 to create tone variations during playing of the guitar 30, the tremolo arm 128 may be pressed forwardly or pulled back to selectively increase or decrease the tension in associated strings 72.

The present invention concerns various aspects of a novel tuning system which accomplishes simple convergence tuning of associated strings. As indicated above, convergence tuning pertains to simultaneously obtaining a desired harmonic length between the nut and bridge critical contact surfaces so that harmonic tuning of corresponding strings 72 is obtained and produces a desired tension in the string 72 so that proper pitch tuning is obtained. Although the bridge assembly 82 and the nut assembly including the nut 38 and the string holder assembly 40 can be modified for use with various types of strings, a preferred set of strings in accordance with the present invention includes strings that correspond to the musical notes E, A, D, G, B and E of a guitar.

As discussed above, in a preferred embodiment, each of the strings 72 include a bullet 74 arranged at one end thereof and a second bullet 78 arranged at the other end. In order to obtain tuning of the strings 72, it is desired for each of the strings to be manufactured to a predetermined convergence length which takes the particular diameter of the string into account. Thus, the convergence length of each of the six strings will correspond to the proper length associated with the particular musical note associated with that string when in a tuned state. This length represents the distance between the nut critical contact surfaces 66 which may be arranged at the same position relative to each other, and corresponding bridge critical contact surfaces 94 which are arranged at different positions with respect to each other.

A typical arrangement of the bridge critical contact surfaces 94 and the associated saddles 86 is shown in FIGS. 7 and 8 and other embodiments of the present invention. However, it should be appreciated that various arrangements of the bridge critical contact surfaces 94 may exist with respect to the nut critical contact surfaces 66 to obtain tuning of associated strings depending upon the gage of string associated with the particular saddles 86 and bridge critical contact points 94.

The desired distance between the termination point 76 of the strings 72 where they exit the associated bullets 74 and the nut critical contact surface 66 is less than about one half inch. In a preferred embodiment, the distance between the termination point 76 which represents an effective end of the string 72, and the nut critical contact surface 66 may be approximately 0.175 inch.

Similar distance relationships exist between the termination point 80 where the strings 72 exit the corresponding bullets 78 and the bridge critical contact surfaces 94. The relatively short distance between the effective ends of the string 72 and their respective critical contact surfaces 66 and 94 at the nut and the bridge is advantageous as it facilitates maintaining of the strings 72 in a tuned state for a longer period of time than strings in prior art guitars. However, it should be understood that the aforementioned preferred distances between the effective ends of the strings and the corresponding critical contact surfaces are not essential to obtain the desired convergence tuning which is accomplished in large part due to the novel structure and operation of the bridge assembly and its relationship with the novel nut assembly of the present invention.

In a preferred embodiment, the bullets 74 and 78 have a hollow central cavity which is used to retain a certain length of string placed therein during manufacture of the string assembly. The length of string arranged within the hollow portion of the bullets 74 and 78 may vary in alternate embodiments along with the length of the bullet itself and the hollow central cavity therein. However, in a preferred embodiment wherein the length of the bullets 74 and 78 is between a quarter inch and three quarters inch long, the length of string arranged within the bullets should be less than about two inches. In a particularly preferred embodiment, the bullets 74 and 78 are about a half inch long and retain about a half inch or less of string therein.

A set of guitar strings 72 having corresponding bullets 74 and 78 arranged at the respective string ends may be packaged for sale as a complete set corresponding to the musical notes E, A, D, G, B and E respectively. Alternatively, set of strings 72 including corresponding bullets 74 and 78 may be packaged which do not correspond with the entire set of standard musical notes. Each of the strings 72 of the set may have the same length extending between the corresponding effective ends (i.e., string length extending between corresponding bullets 74 and 78). When all of the strings 72 of a particular set have the same length, special modifications to the present tuning systems may be desirable. The special modifications will be discussed in more detail below. Alternatively, certain of the strings 72 of a particular set may have a different length which corresponds to the proper convergence length associated with a particular string gauge and the corresponding musical notes. Such a set of strings is preferably used with the nut assembly of FIGS. 1–6 in combination with the bridge assembly of FIGS. 7–12. It should also be appreciated that when a set of strings 72 is provided where certain of the strings 72 have a different predetermined length than other strings within the set, these strings can also be used with the modified embodiments of the present invention which will be discussed below with respect to FIGS. 18–21 and 25.

Another aspect of the present invention pertains to a method of manufacturing the strings 72 including the bullets 74 and 78 affixed to the ends thereof, as well as for determining the length of the strings 72 to be manufactured. The desired length of each of the strings 72 between its effective end at termination point 76 and its effective end at termination point 80 is selected to correspond with a convergence length at which harmonic and pitch tuning of the string may be simultaneously obtained when used in connection with the novel convergence tuning system of the present invention. As indicated above, this length is preferably no greater than the distance between the nut and bridge critical contact surfaces 66 and 94 plus approximately one inch±¾ inch. Still even more preferably, the distance is equal to about the distance between the nut and bridge critical contact surfaces 66 and 94 plus approximately 0.350 inch (approximately 0.175 inch between each effective end 76 and 80 of the strings 72 and the corresponding critical contact surfaces 66 and 94 at the nut and the bridge).

In accordance with the method of determining the length of a string 72 to be manufactured for use with a stringed instrument, such as a guitar 30, the strings are usually placed across and in contact with effective nut and bridge critical contact surfaces. The term "effective" has been chosen because the nut and bridge critical contact surfaces may be the actual critical contact surfaces of a guitar, or may be simulated critical contact surfaces in a laboratory or manufacturing environment which is merely representative of the proper distance between the nut and bridge critical contact surfaces of an actual guitar. The string should then be harmonically and pitch tuned. While the string is in its tuned state, the length between the nut and bridge critical contact surfaces should be determined. Additionally, a compensation length which represents a combined desired distance beyond the effective nut and bridge critical contact surfaces can be determined and added to the length between the effective nut and bridge critical contact surfaces to thereby obtain an overall convergence length at which simultaneous harmonic and pitch tuning of the string can be obtained when the string is arranged in an associated stringed instrument, such as a guitar. Once the convergence length is determined, a desired length of string, representative of the length to be placed within the associated bullets, should be added to the convergence length so that an overall cutting length is obtained. The string 72 should then be cut.

Cutting of the string 72 may be performed when it is in a relaxed state or under tension. However, it is preferable to perform such cutting when the string is relaxed. A bullet 74, 78 is then secured to each end of the string so that the distance that the string 72 extends between the bullets 74, 78 at its effective ends will be representative of the desired convergence length at which simultaneous harmonic and pitch tuning can be obtained when the string 72 is placed in a assembled position on a guitar 30 having the tuning system of the present invention.

Another advantageous feature of the strings 72 of the present invention including the bullets 74 and 78 mounted at both ends thereof, is that the strings 72 are unencumbered along their effective length. That is, they do not include any additional twisted wire along the effective length. This results in a crisp, clean sound when the string is strummed or plucked which will be free of unwanted vibrations and which will be representative of the proper tone that is desired for a particular string.

Use of the present invention permits simple replacement of the strings 72 when desired. In order to accomplish such replacement, all that is required is that the bullets 74 and 78 of the strings to be replaced be removed from their assembled position within corresponding cavities 42 of the string holder 40 and corresponding cavities 88 of the saddle members 86. The longitudinal force exerted on the bullets by the spring biased ball plungers 50 does not inhibit removal or replacement of the bullets with respect to their respective cavities 42 or 88.

Convergence tuning can be simply and quickly accomplished by an average guitar player using the tuning system of the present invention. Unlike prior art guitars which require various tuning operations to accomplish pitch and harmonic tuning of the guitar string, after initial set up adjustments are performed, the tuning system of the present invention only requires a simple adjustment of a single tuning knob 116 that is associated with one of the strings 72. As illustrated in FIG. 1, when a guitar having six strings is used in connection with the bridge assembly 82 of the present tuning system six tuning knobs 116 are associated with the bridge assembly 82. Each of these tuning knobs is operatively associated with one of the corresponding strings 72.

Replacement and tuning of the strings 72 may take place as follows. The tuning knob 116 associated with the saddle member 86 that corresponds with the string 72 to be replaced, should be moved to a position which permits the associated lever arm 98 and the corresponding saddle member 86 to rotate about the shaft 96 so that a corresponding bridge critical contact surface 94 is moved toward a corresponding nut critical contact surface 66. The precise length of the corresponding string 72 is such that it will now be relaxed to allow removal and replacement of the bullets 74 and 78 in the corresponding cavities 42 and 88.

In order to obtain simultaneous harmonic and pitch tuning, the corresponding tuning knob 116 should then be rotated so that the threaded shaft 118 moves downwardly toward the associated lever arm 98. This will cause the saddle member 86 to rotate about the shaft 96 so that the corresponding bridge critical contact surface 94 pivots away from the critical surface point 66 at the nut. This movement causes constant simultaneous changing of the harmonic length and the pitch of the associated string as both are simultaneously increased. When the required tension is present in the string to produce the desired pitch, the harmonic length will automatically converge to provide proper harmonic tuning of the string. Thus, the present invention provides a one-to-one relationship between each of the nut critical contact surfaces 66, the bridge critical contact surfaces 94, the saddle members 86 on which the bridge critical contact surfaces 94 are arranged, and the tuning knob 116. This can be distinguished from prior art tuning systems which require multiple adjustments of a plurality of tuning mechanisms associated with each of the strings in order to accomplish proper pitch and harmonic tuning.

The vertical height of the strings 72 with respect to the surface of the fretboard 36 can be adjusted by rotating corresponding vertical height adjustment screws 106 which vertically displace the saddle 86 with respect to the surface of the platform 100 arranged on the lever arm 98 so that the size of the space 110 between the saddle 86 and the platform 100 is adjusted. This feature of the present invention will permit guitar players to individually adjust the "action" of each of the strings to suit their style of guitar playing. It should be appreciated that the tuned state of the strings 72 will be slightly modified each time a vertical height adjustment is made in accordance with the aforementioned feature of the present invention. Thus, it may be required for a guitar player to return the strings 72 by using the tuning knob 116 after selective vertical height adjustments have been made by rotating the vertical height adjustment screws 106. After the retuning step has been performed, triple convergence of the harmonic length, the pitch and the vertical height of the strings 72 with respect to the fretboard 36 will be obtained.

In an optional embodiment of the present invention, the saddles 86 may be mounted in different relative positions with respect to their corresponding lever arms 98. This optional embodiment of the present invention will facilitate tuning by varying the relative distance between bridge critical contact surfaces 94 and corresponding nut critical contact surfaces 66. In particular, the relative selective placement of the saddles 86 on corresponding lever arms 98 may be accomplished by varying the position of apertures 102 or 104 in corresponding lever arms 98. According to this embodiment of the present invention, the apertures 102 or 104 on certain lever arms 98 will be displaced with respect to their relative location of different lever arms 98. However, the displaced apertures 102 or 104 must still be aligned with each other so that the corresponding shafts 96 or 112 can extend through all of the lever arms 98.

The relative change in position of selected apertures 102 or 104 will cause the saddle 86 which corresponds to the lever arms 98 to be moved closer or further from the nut 38. This will result in a staggered arrangement of the saddles 86 as shown in FIGS. 7 and 8. Thus, adjustment of the position of the apertures 102 or 104 with respect to certain of the corresponding lever arms 98 will modify the relative position of associated saddle members 86 to correspond with a desired harmonic length for selective ones of the strings 72*a–f*.

The relative selective placement of the saddles 86 on corresponding lever arms 98 may also be accomplished by varying the position of the apertures 105, which extend through the rear end of the saddle members 86, with respect to the corresponding bridge critical contact surfaces 94. It should be appreciated that when it is desired to offset the various relative positions of selected saddle members 86 with respect to the corresponding lever arms 98, the front of the saddle members 86 will move with respect to the front of the corresponding platform 100. Such movement is acceptable provided that it is within a certain range so that the adjustment screws 106 will still contact the platform 100 as they extend through corresponding threaded passageways 108 at the front end of the saddle 86. As indicated above, this aspect of the present invention is optional as proper tuning may be accomplished simply by using the tuning knobs 116 when all of the apertures 102, 104 and 105 are arranged in the same relative position on all of the lever arms 98 and saddle members that all of the saddle members 86 are placed in the same relative position with respect to the lever arms 98.

This optional aspect of the present invention will now be explained with respect to one preferred embodiment. Thus, in order to accommodate the various harmonic lengths associated with certain strings 72 of the guitar 30, the distance between the apertures 105 which extend through the rear end of the saddle members 86 and the corresponding bridge critical contact surfaces 94 will vary depending upon the placement of the saddle members 86 with respect to the base 84 of the bridge assembly 82. For instance, the distance between the passageway 105 and the corresponding bridge critical contact surface 94 of the right most saddle member 86, which corresponds to the sixth guitar string 72, is less than the distance between the passageway 105 and the critical contact surface 94 of the corresponding saddle member 86 associated with the fifth guitar string. Similarly, the distance between the passageway 105 of the corresponding saddle member 86 and the critical contact surface 94 associated with the fourth guitar string will be greater than the distance between the passageway 105 and critical contact surface 94 of the saddle member 86 associated with the fifth guitar string. These distances will be selected to correspond with the convergence length of the string 72 associated with the particular saddle member 86 and the corresponding nut critical contact surface 66.

In a preferred embodiment of the present invention, the distance between the passageway 105 in a given saddle 86 and the corresponding bridge critical contact surface 94 will be greater in saddles associated with longer harmonic lengths than saddles associated with shorter harmonic lengths. In other words, if the harmonic length between a particular bridge critical contact surface 94 and a corresponding nut critical contact surface 66 is relatively short, then the distance between the passageway 105 and the bridge critical contact surface 94 of that saddle will also be relatively short when compared to other saddles. Similarly, the distance between the passageway 105 and the rear of the saddle 86 and the bridge critical contact point 94 near the front of the saddle will be relatively large for saddles associated with strings having a relatively long harmonic length, such as strings 72*a* and 72*d*. The variation in the distance between the passageways 105 and the bridge critical contact surfaces 94 of various saddles 86 accounts for the staggered orientation of the saddles 86 shown in FIGS. 7 and 8, and other embodiments of the present invention, when the corresponding strings are in a tuned state.

Figure 15:
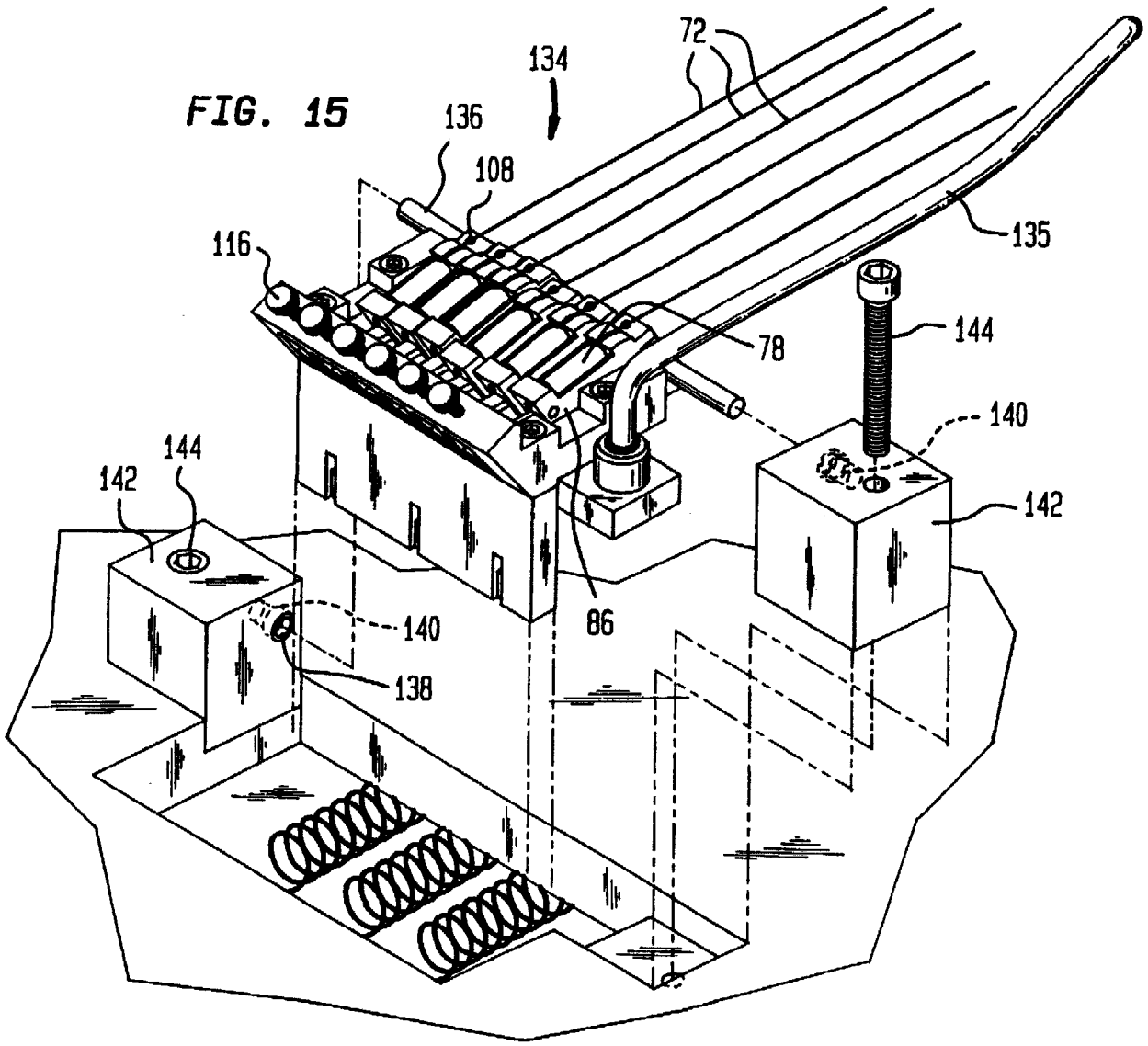
FIG. 15 is a partially exploded perspective view of another embodiment of the present invention including a tremolo bridge assembly.

A further embodiment of the present invention relates to a new tremolo design generally designated 134 in FIG. 15. Movement of the tremolo 134 is accomplished by pushing forward or pulling back, on a tremolo arm 135 which causes rotation about a shaft 136. The shaft 136 serves a dual purpose as it permits pivotal rotation of the saddle members 86 and the corresponding bridge critical contact surfaces 94 upon adjustment of the corresponding tuning knobs 116, and it also acts as the main pivot shaft about which the entire tremolo 134 rotates. The shaft 136 may be mounted for rotation about ball bearings 140 arranged within a recess 138 of corresponding mounting blocks 142. As illustrated in FIG. 15, the mounting blocks 142 may be secured to the guitar body 32 by mounting screws 144 which extend through corresponding mounting blocks 142 and into corresponding threaded passageways within the guitar body. The tremolo 134 includes all of the same tuning features of the bridge assembly 82 discussed above.

Figure 16:
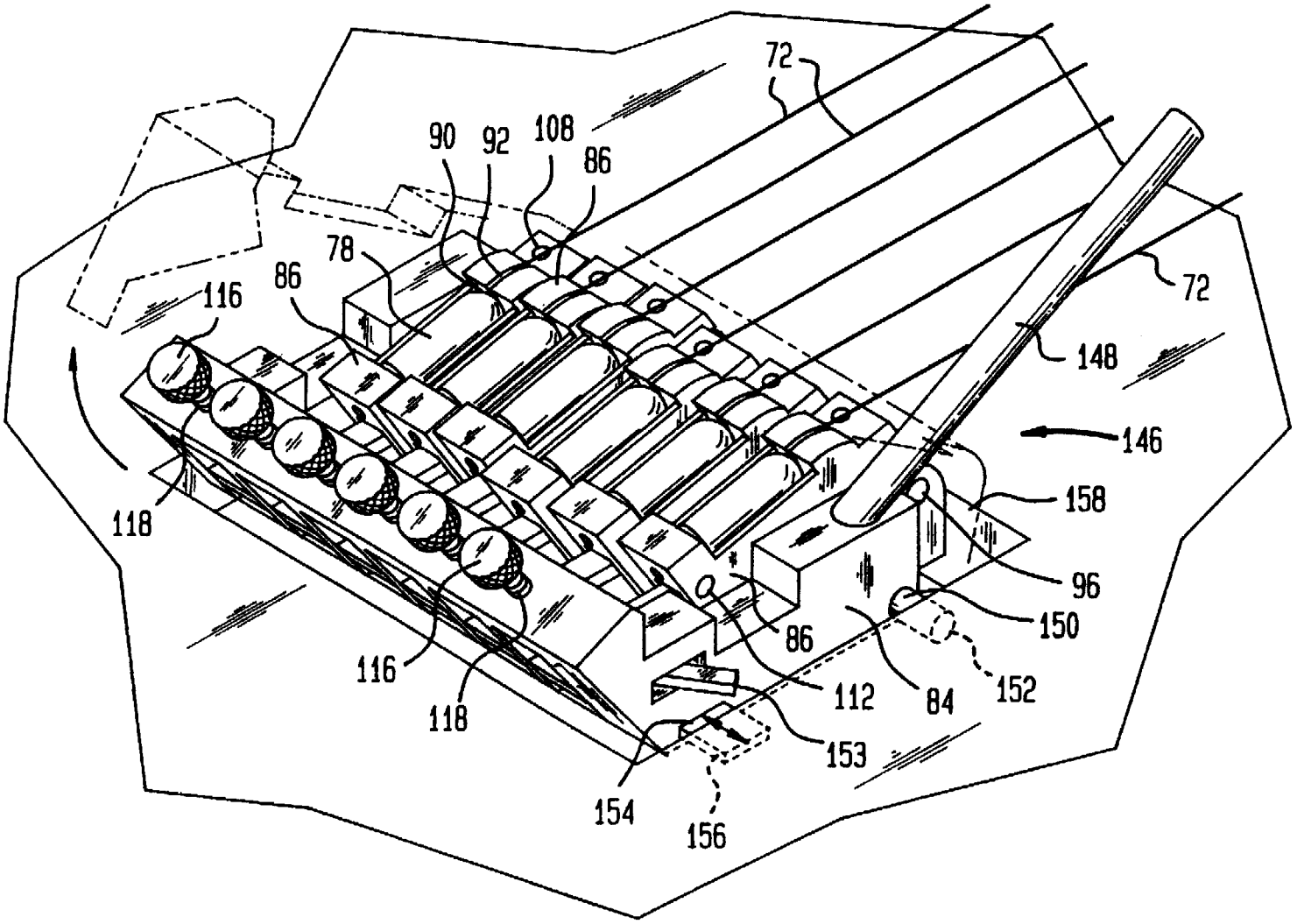
FIG. 16 is an enlarged perspective view of a pivotable bridge assembly in accordance with the present invention.

FIG. 16 discloses another aspect of the present invention. In particular, FIG. 16 shows a bridge assembly 146 having the same convergence tuning features as the bridge discussed above in connection with FIGS. 7–13. However, the bridge 146 disclosed in FIG. 16 also includes additional features which permits the bridge 146 to be selectively pivoted forward toward the nut 38 so that all six strings 72 can be replaced at the same time. Additionally, the bridge 146 has means for tuning all six strings 72 at the same time when the bridge 146 is pivoted from a loading position (partially shown in phantom in FIG. 16) at which the bridge 146 is moved forward as far as possible toward the nut 38 so that tension in the strings 72 is substantially eliminated, to a playing position (illustrated in solid lines in FIG. 16) where the rear end of the bridge 146 is arranged closer to the body 32 than it is when it is in the loading position so that the strings 72 are under playing tension.

The bridge 146 may be selectively locked in a playing position on the guitar body 36 by moving a manual latch 153 to activate a locking bar 154 so that the locking bar 154 extends into a corresponding cutout arranged in the body 32 of the guitar 30. The bridge 146 is shown in this position in FIG. 16.

In order to pivot the bridge assembly 146 to its loading position (illustrated in phantom), the lever arm 148 should be pulled up and the latch 153 is then pushed to its unlocked position which causes the locking bar 154 to retract into the base 84 of the bridge assembly 146. The lever arm 148 may then be pushed forward so that the bridge assembly 146 will pivot about the shaft 150 received within aligned bores 152 in the guitar body 36. The strings 72 will no longer be under tension when the bridge assembly 146 is in its loading position. Thus, the strings can easily be replaced at this time. When the replacement strings 72 are arranged in the proper assembled position, the bridge assembly 146 can then be pivoted back into its playing position by pulling up on lever arm 148, and locked into place in the respective guitar body 32.

Figure 17:
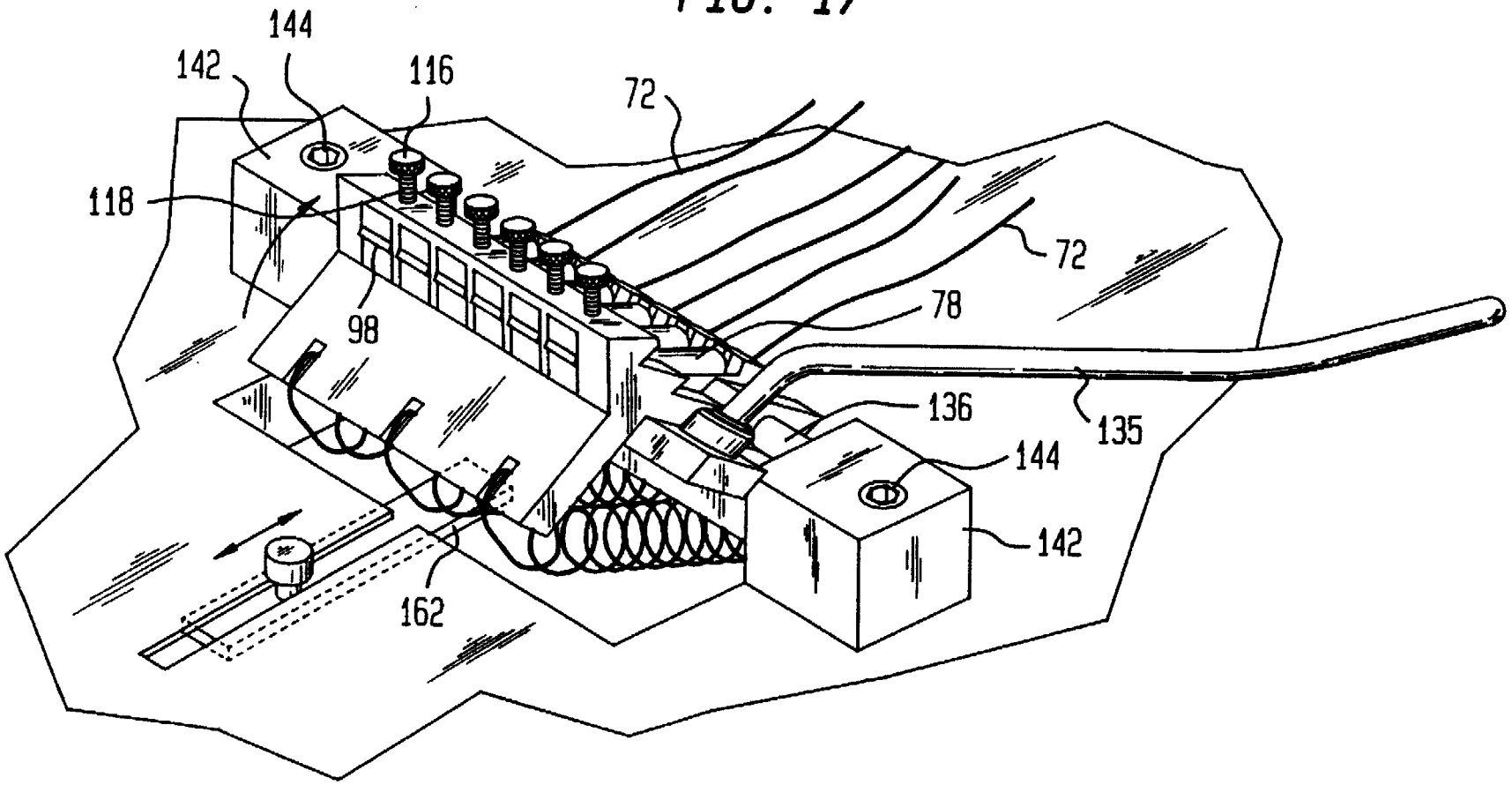
FIG. 17 is a perspective view of another embodiment of a pivotable tremolo bridge assembly in accordance with the present invention.

In order to simplify the loading process of more than one string at the same time in accordance with the embodiment of the present invention shown in FIG. 16, it may be desirable to use a locking device which locks the bridge in a loading possition until loading of all the associated strings is complete. To this end, FIG. 17 illustrates a slidable locking bar 162 used in combination with the tremolo 134 of the embodiment shown in FIG. 15. The locking bar 162 will permit the tremolo 134 to be locked forward in a loading position so that one or more of the associated strings 72 can be easily installed in the corresponding cavities 88 of the saddles 86 and the cavities 42 of the string holder 40.

Figure 18:
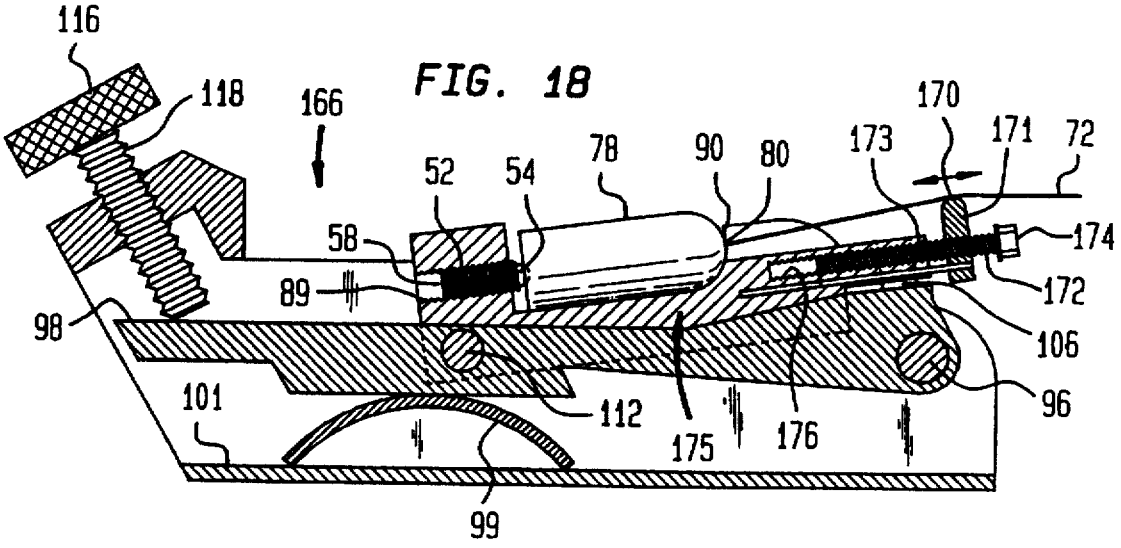
FIG. 18 is an enlarged cross-sectional view of another embodiment of a bridge assembly including a corresponding string wherein the bridge critical contact surfaces are both pivotably and slidably adjustable.

In order to accommodate the needs of professional guitar players who require the strings be tuned in accordance with their personal preference, and to facilitate use of a set of strings 72 which all have the same length, the present invention includes a further embodiment in which the bridge critical contact surfaces 94 are both pivotally adjustable and slidable with respect to corresponding nut critical contact surfaces 66. In particular, FIG. 18 illustrates a modified version of the bridge assembly shown in FIG. 7 wherein the bridge critical contact surfaces 170 replace critical contact surfaces 94. The critical contact surfaces 170 are not arranged at a fixed position on corresponding saddles 175. In this embodiment, the bridge critical contact surfaces 170 are arranged on individually adjustable bridge elements 171 which are slidable with respect to the termination point 80. The individually adjustable bridge elements 171 are arranged on corresponding threaded shaft 172 having a head 174 for adjusting the relative position of the critical contact surfaces 170 with respect to the termination point 80. The front of the saddle members 175 include an extended area 173 which has a threaded bore 176 therein for receiving the threaded shaft 172.

As with the embodiment shown in FIGS. 6–13, pivotal movement of the saddle members 175 will still cause pivotal movement of corresponding bridge critical contact surfaces 170. An initial setting of the bridge critical contact surfaces 170 with respect to the corresponding retaining shoulder 90 of the saddle cavities 88 will be provided upon purchasing of the bridge assembly 166 or a guitar 30 on which the bridge assembly 166 is mounted.

Convergence tuning of the harmonic length and the pitch of associated strings 72 will be accomplished in this embodiment by adjustment of the corresponding tuning knobs 116 as discussed above. If a particular player desires to slightly modify the harmonic length of the associated string 72, the corresponding adjustable bridge element 171 and the associated bridge critical contact surface 170 can be slidably moved toward or away from the termination point 80 upon rotation of the head 174 of the threaded shaft 172.

Figure 19:
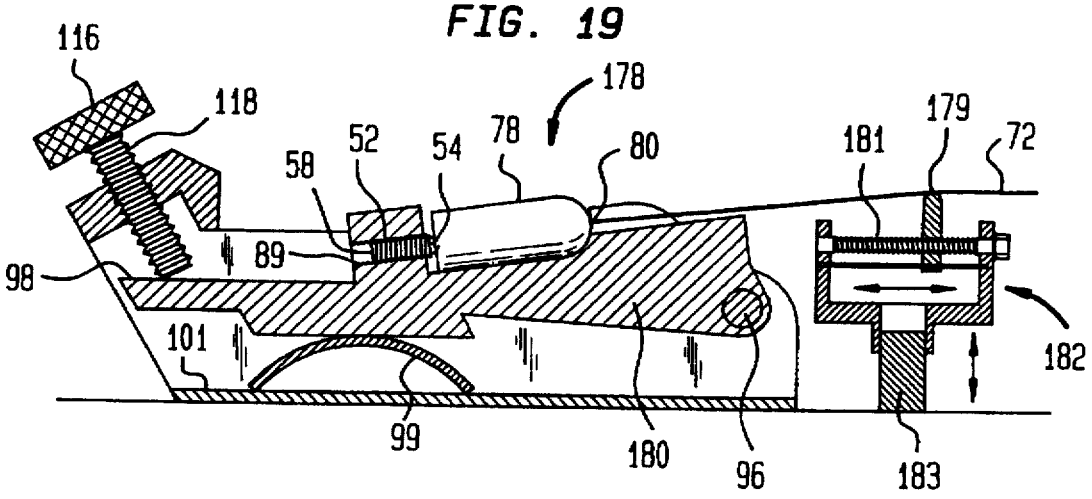
FIG. 19 is an enlarged cross-sectional view of a further embodiment of a bridge assembly including a corresponding string wherein the bridge critical contact surface is slidably adjustable.

FIG. 19 illustrates a further embodiment of the present invention wherein the adjustable bridge elements and the associated bridge critical contact surfaces 179 of a bridge assembly 178 are not mounted on corresponding pivotable saddle members 180. Instead, in this embodiment, the adjustable bridge elements and the associated bridge critical contact surfaces 179 are mounted on one or more separate assemblies 182 situated on the body 32 of the guitar 30 at a selected spaced distance from the corresponding saddle members 180. In this embodiment, the adjustable bridge elements are slidably arranged on an associated threaded shaft 181 which is rotatably journaled in the support assembly 182. The support assembly 182 can be vertically adjusted along a vertical shaft 183. The vertical shaft 183 may be secured to the body 32 of the guitar 30 by conventional means such as screws, rivets, glue and the like. In this embodiment, convergence tuning does not take place.

The additional adjustability aspect of the bridge critical contact points 170 and 179 of FIGS. 18 and 19 respectively, are useful for guitar players who wish to vary the tuning of the associated string 72 from a standard pitch to other desired pitches to accommodate their personal tastes. In particular, the embodiments of FIGS. 18 and 19 will permit guitar players to easily obtain variations from standard pitch to one quarter or one half notes flat or sharp.

Figure 20:
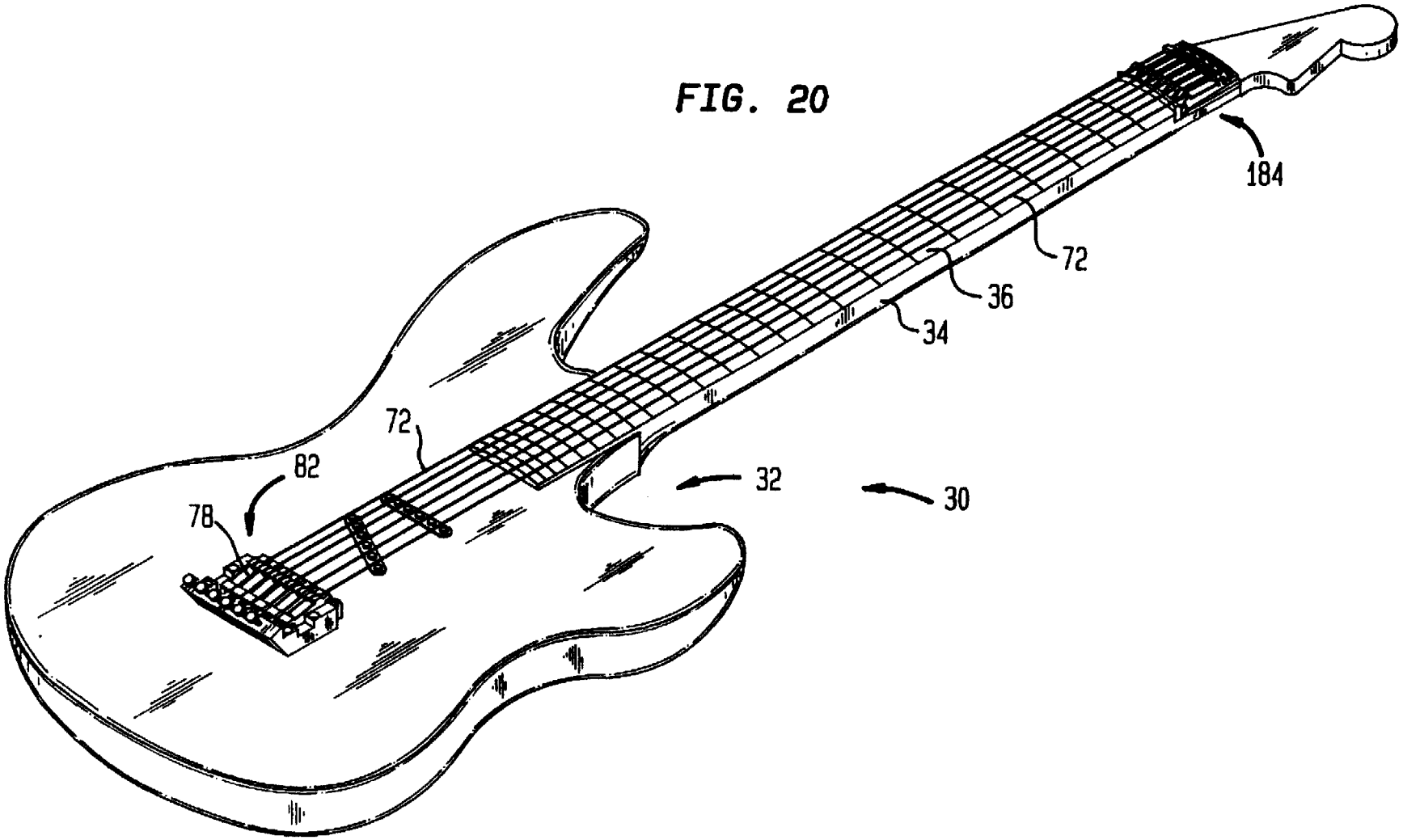
FIG. 20 is a perspective view of a guitar in including a tuning system having a nut assembly with pivotably adjustable string holders in accordance with another embodiment of the present invention.
Figure 21:
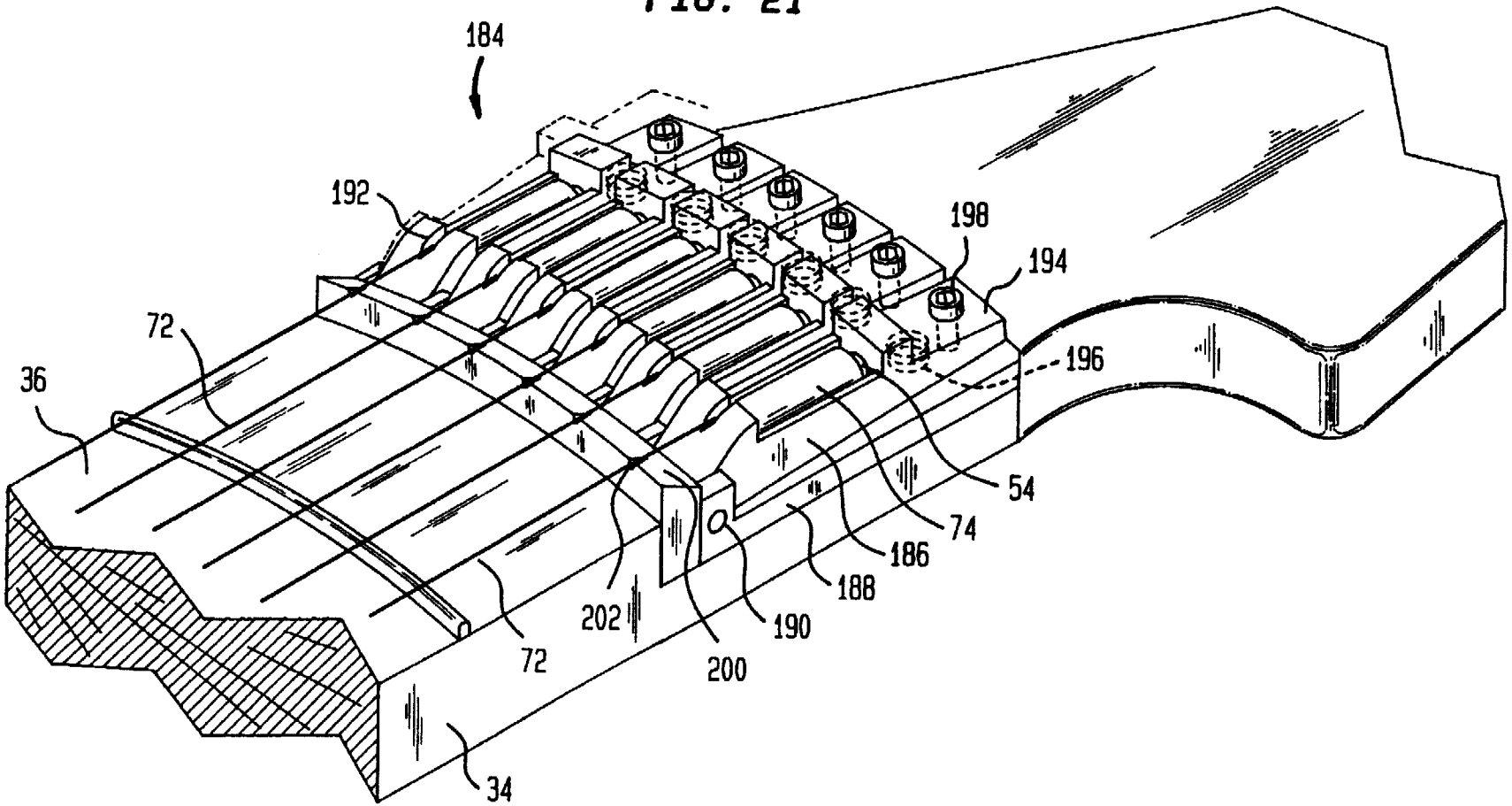
FIG. 21 is an enlarged perspective view of the nut assembly shown in FIG. 20.

A further embodiment of the present invention is shown in FIGS. 20 and 21. This embodiment includes a nut assembly 184 having individually pivotable string holders 86. The bridge assembly 82 may be identical to any one of the bridge assemblies discussed above, or may be a modified bridge assembly.

Each of the string holders 186 are pivotally mounted for pivoting about a common shaft 190. The string holders 186 include corresponding cavities similar to cavities 42 of the string holders discussed above and shown in FIGS. 3 and 6. As in the embodiment discussed above with respect to FIGS. 2–5, each of the cavities have a front shoulder which is adapted to engage the front end of the associated bullets 74 and a rear shoulder. Spring biased ball plungers (not shown) extend through corresponding passageways in the rear shoulders in substantial alignment with the center axis of the cavities. As discussed above, the spring biased ball plungers 50 urge the associated bullets 74 forward into the front shoulder of the corresponding cavities so that the strings 72 may be retained in a secured position during playing of the guitar 30.

The nut assembly 184 includes a nut 200 having a plurality of corresponding nut critical contact surfaces 202 for supporting the strings 72 in associated grooves 192 at a desired distance from the associated termination point 80. As in the other embodiments of the present invention, the critical contact surfaces 202 of the nut 200 are not adjustable. However, the individual string holders 186 may be pivotally adjustable about the shaft 190. Such adjustment can be accomplished by turning adjustment screws 198 which extends through corresponding vertically arranged bores within the rear end 194 of the individual string holders 186. The adjustment screws 198 are then received by corresponding threaded passageways extending vertically within the neck 34 of the guitar 30. A spring (shown in phantom) is arranged between the surface of the neck 34 of the guitar 30 and the bottom of the rear end 194 of the individual string holders 186 so that the rear end 194 of the corresponding individual string holders 186 is constantly urged upward away from the neck 34 of the guitar 30.

In operation, the individually adjustable string holders 186 cooperate with adjustment of the corresponding saddles of the bridge assembly in obtaining convergence tuning of the associated strings 72.

Figure 25:
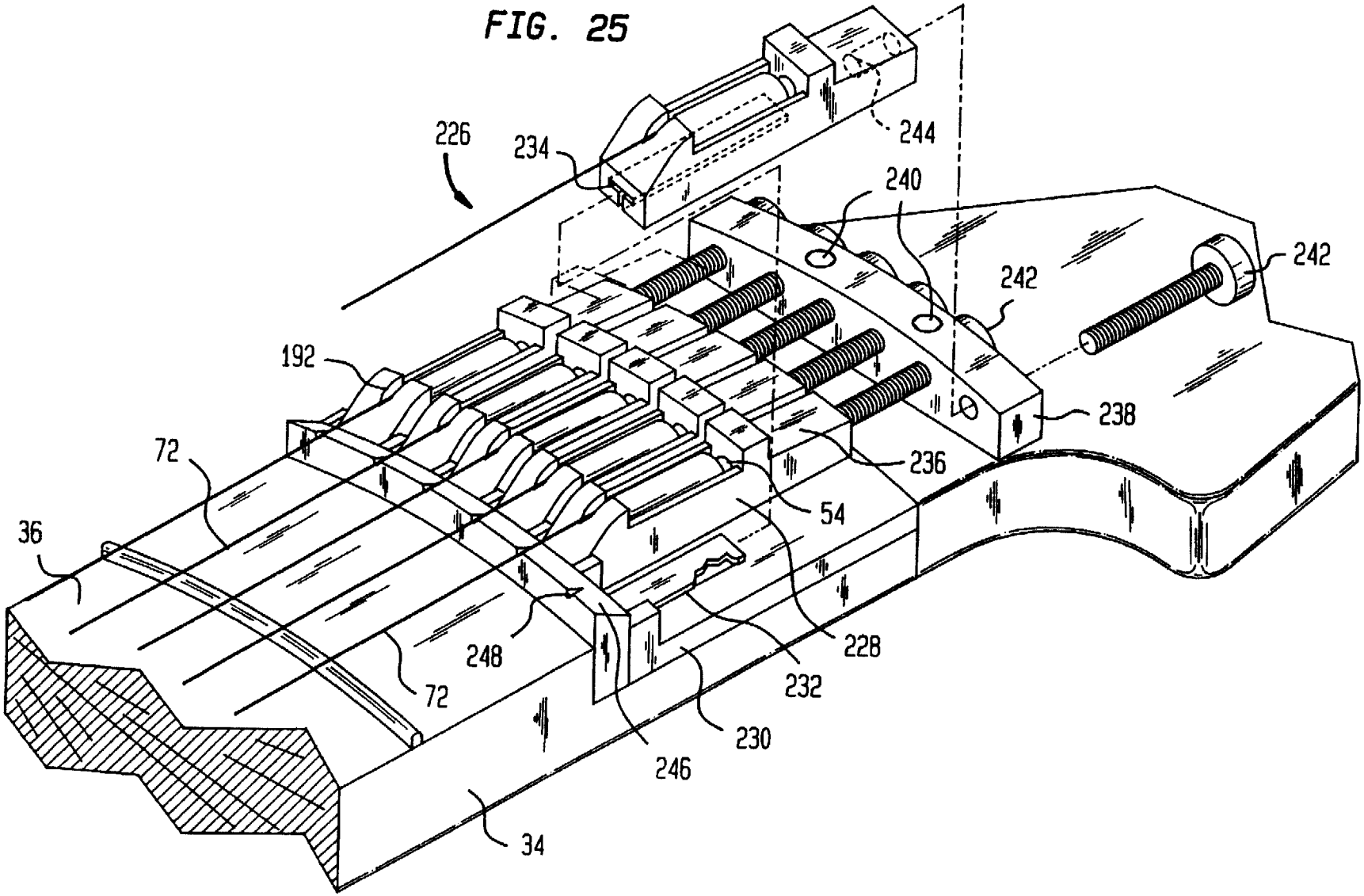
FIG. 25 is an enlarged partially exploded perspective view of another embodiment of a nut assembly having slidably adjustable string holders in accordance with the present invention.

An additional embodiment of the present invention is shown in FIG. 25. This embodiment is similar to the embodiment shown in FIGS. 20 and 21 in that the nut assembly 226 of FIG. 25 has individually adjustable string holders 228. The difference between the embodiment shown in FIG. 25 and the embodiment of FIGS. 20 and 21 is that the individually adjustable string holders 228 are slidable with respect to the nut 246, as opposed to being pivotally mounted about a common shaft.

In particular, the nut assembly 226 shown in FIG. 25 includes individually adjustable string holders 228 which are slidable on a T-shaped track 232. The T-shaped track 232 is mounted on a base 230 and extends into an aligned corresponding cut-out 234 (shown partially in phantom) which extends from the front end of the individually adjustable string holders 228 toward the rear end 236 thereof. A mounting member 238 extends transversely with respect to the neck 34 of the guitar and may be removably secured to the head of the guitar. A pair of connecting screws 240 extend through the mounting member 238 into corresponding threaded passageways in the neck of the guitar to assure that the mounting member 238 is securely assembled thereon.

A threaded passageway 244 is longitudinally arranged within the rear end 236 of each of the individually adjustable string holders 228. A threaded adjustment screw 242 may be arranged to extend through corresponding bores within the mounting member 238 and into corresponding threaded passageways 244 of the individually adjustable string holders 228.

A guitar player may modify the pitch of selected strings 72 by adjusting the longitudinal position of the individually adjustable string holders 228 upon rotating the corresponding adjustment screws 242. If the individually adjustable string holders 228 are pulled away from the associated nut 246, the tension in the corresponding strings 72 will increase, thus causing a higher pitch.

As in the embodiment of the present invention shown in FIGS. 20 and 21, adjustment of the individually adjustable string holders 228 will not cause movement of the nut 246 toward the corresponding nut critical contact points 248. Instead, adjustment of the nut assembly 226 may be performed in combination with adjustment of an associated bridge assembly, such as bridge assembly 82, in order to obtain the desired convergence tuning.

The embodiments of the present invention shown in FIGS. 18–21 and 25 provide means for further adjusting the harmonic convergence point which is particularly useful when strings 72 which all have the same length are used. To this end, the bridge shown in FIGS. 7–12 may be used in combination with the nut assemblies having individually adjustable string holders shown in FIGS. 21 and 25. Alternatively, the bridge assemblies 66 or 178 shown in FIGS. 18 and 19 respectively may be used in combination with the nut assemblies shown in FIGS. 1–6 when all of the strings 72 of a particular set have the same length. It should be appreciated that it is not required to use these modified embodiments of the present invention when all of the strings 72 of a particular set have the same length. However, use of these modified embodiments which permit additional adjustment of the relative position between the bridge and the nut critical contact surfaces is advantageous when the strings 72 of a particular set all have the same length. These modified embodiments are slightly more completed to manufacture than the nut and bridge embodiments of FIGS. 1–12. However, since it may be desirable to manufacture all of the strings 72 to the same effective length, the modified bridge and nut embodiments of FIGS. 18–21 and 25 may be desirable. An additional advantage of using the bridge and nut embodiments of FIGS. 18–21 and 25 is that they provide guitar players with a wider tuning range to accommodate their personal preference which may include a non-standard pitch, or additional tuning modifications to compensate for a desired finger pressure.

A general advantage that the present tuning system provides over any prior art tuning systems is that it eliminates tuning pegs at the head of the guitar. In certain embodiments of the present invention, such as the embodiment which uses the nut assemblies of FIGS. 1–6, tuning adjustments at the nut are entirely eliminated. Further, the structure of the various embodiments of the bridge and nut assemblies of the present invention eliminates the requirement to manufacture those assemblies out of hard and steel materials, which were previously required in prior art tuning systems so that the associated guitar strings may be properly clamped in a secured position.

A further advantage of the various embodiments of the tuning system of the present invention is that it eliminates the need to use wrenches, which were previously required in prior art systems to open and close string clamps.

Figure 22:
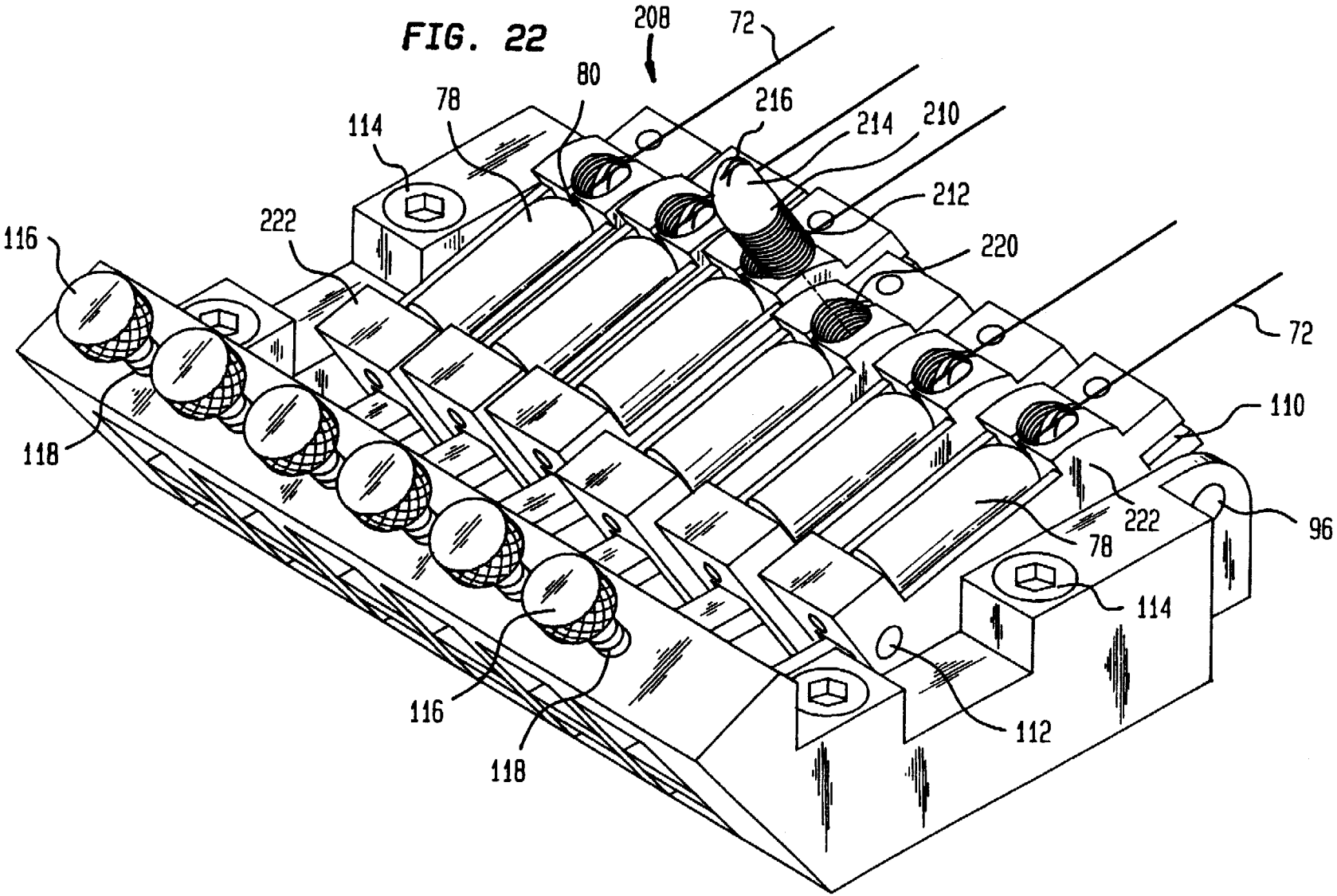
FIG. 22 is an enlarged partially exploded perspective view of another embodiment of a bridge assembly in accordance with the present invention particularly illustrating rotatable bridge members.
Figure 23:
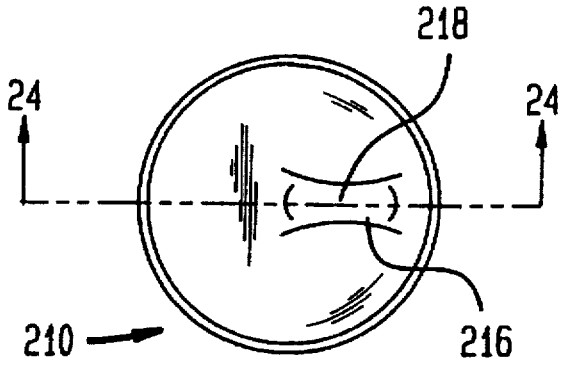
FIG. 23 is an enlarged top plan view of a rotatable bridge member of the bridge assembly as shown in FIG. 23.
Figure 24:
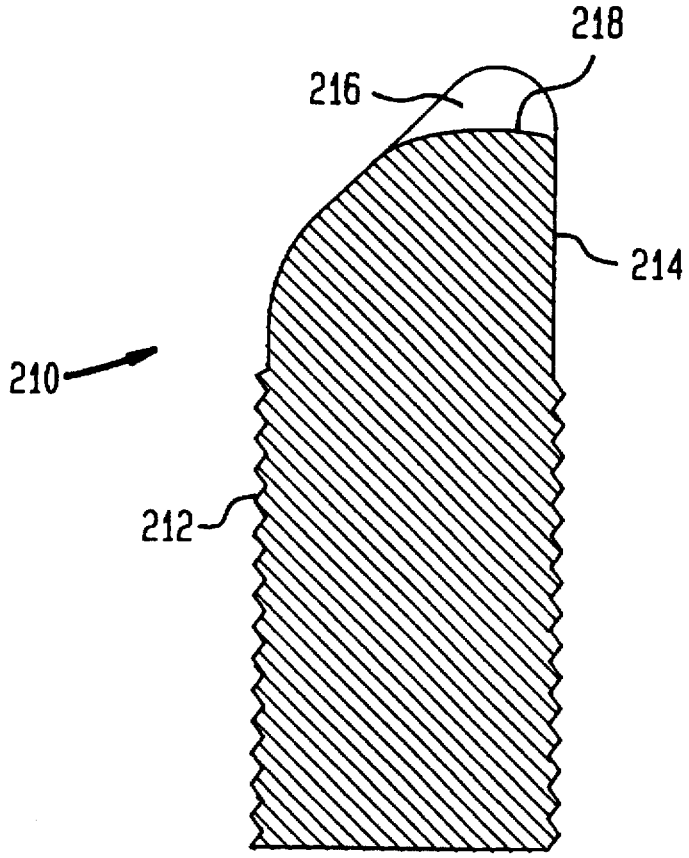
FIG. 24 is an enlarged cross-sectional view of the rotatable bridge member taken along line 24—24 as shown in FIG. 23.

FIGS. 22–24 illustrate yet another embodiment of the present invention in which a plurality of rotatable pegs 210 may be selectively rotated so that gross adjustment of the bridge critical contact surfaces 218 may be obtained. To this end, the bridge critical contact surfaces 218 may be rotated along with the rotatable pegs 210 between a first position at which they are relatively far from the termination point 80 to a second position at which the bridge critical contact surfaces are closer to the termination point 80.

Most of the components of the bridge assembly 208 are identical to the components of the bridge assembly 82 shown in FIG. 7. The difference is that the bridge critical contact surfaces 218 are not fixed in a single position at the end of the associated saddle member 222. In particular, each of the saddle members 222 include a sized and shaped threaded bore 220 for receiving a corresponding threaded body 212 of a rotatable peg 210. The rotatable pegs 210 include an asymmetrical top surface 214 where one side is higher than the other. Corresponding bridge critical contact surfaces 218 are arranged at a selected location on the top surface 214 of the rotatable pegs 210. A groove 216 is arranged at a central position on the top section 214 of the rotatable pegs 210 adjacent to corresponding bridge critical contact surfaces 218.

When the rotatable pegs 210 are arranged in assembled position within corresponding bores 220 of the saddle members 222, the strings 72 will extend through associated grooves 216 and will be placed in contact with corresponding bridge critical contact surfaces 218.

This embodiment of the present invention is designed to give certain guitar players flexibility in selecting the position of the bridge critical contact surfaces. This is accomplished by rotating the rotatable 210 pegs by 180° so that the groove 216 extends along the longitudinal axis of the associated string 72. In a preferred embodiment, the bridge critical contact surfaces 218 at the top section 210 of the rotatable pegs 210 will preferably move less than a quarter inch and more preferably approximately a sixteenth of an inch when a corresponding rotatable peg 210 is rotated approximately 180°.

While the foregoing description and figures are directed toward the preferred embodiments of the present invention, it should be appreciated that numerous modifications can be made to the structure and orientation of the various components of the present tuning system. Indeed, such modifications are encouraged to be made in the materials, structure and arrangement of the components of the present tuning system and the steps of the present methods of determining the convergence string length of guitar strings and manufacturing such strings without departing from the spirit and scope of the present invention. Accordingly, the foregoing description of the preferred embodiment should be taken by way of illustration rather than by way of limitation as the present invention is defined by the claims set forth below.

I claim:

1. A set of strings for a musical instrument having a nut and a bridge including a plurality of bridge critical contact surfaces each spaced at a desired distance from said nut, said set of strings comprising:

a plurality of strings having a first end and a second end and a predetermined length between said first and second ends, said predetermined length being no greater than the distance between said nut and a corresponding one of said bridge critical contact surfaces plus one inch whereby each said predetermined length corresponds to a tuned harmonic length upon placement of said plurality of strings in assembled position across said nut and said bridge critical contact surfaces on the associated musical instrument.

2. The set of strings of claim 1, wherein said musical instrument is a guitar and said plurality of strings comprise six strings, each of said six strings corresponding to the musical notes E, A, D, G, B and E respectively.

3. The set of strings of claim 1, further comprising a first anchor affixed to said first end of each of said plurality of strings and a second anchor affixed to said second end of each of said plurality of strings.

4. The set of strings of claim 1, wherein each said predetermined length is equal to distance between said nut and its corresponding bridge critical contact surfaces plus no greater than 0.350.

5. The set of strings of claim 4, further comprising a first anchor affixed to said first end of each of said plurality of strings and a second anchor affixed to said second end of each of said plurality of strings.

6. The set of strings of claim 5 wherein said musical instrument is a guitar and said plurality of strings comprise six strings, each of said six strings corresponding to the musical notes E, A, D, G, B and E respectively.

7. The set of strings of claim 5, wherein said first and second anchors comprises respective first and second bullets.

8. The set of strings of claim 1 wherein at least certain of said plurality of strings have a different predetermined length.

9. A set of strings for a musical instrument, said set of strings comprising:

a plurality of strings having a first end and a second end and a predetermined length between said first and second ends, said predetermined length being selected to correspond with a convergence length at which harmonic and pitch tuning of corresponding ones of said plurality of strings are simultaneously and instantly obtained upon placement of said strings in their assembled position within an associated stringed instrument.

10. The set of strings of claim 9 wherein said musical instrument is a guitar and said plurality of strings comprise six strings, each of said six strings corresponding to the musical notes E, A, D, G, B and E respectively.

11. The set of strings of claim 9, further comprising a first anchor affixed to said first end of each of said plurality of strings and a second anchor affixed to said second end of each of said plurality of strings.

12. The set of strings of claim 11, wherein said first and second anchor comprises respective first and second bullets.

13. The set of strings of claim 9, wherein said musical instrument is a guitar including a nut and a bridge having a plurality of bridge critical contact surfaces each spaced at a desired distance from said nut, said convergence length of each said plurality of strings being equal to the distance between said nut and said bridge critical contact surfaces plus an additional distance required to permit tuning of the guitar in such a manner so as to simultaneously obtain harmonic and pitch tuning of the corresponding plurality of strings.

14. The set of strings of claim 9 wherein at least certain of said plurality of strings have a different predetermined length.

15. A string for a musical instrument having a nut and a bridge including a bridge critical contact surface spaced at a desired distance from said nut, said string comprising a first end and a second end and having a predetermined length no greater than the distance between said nut and said bridge critical contact surface plus one inch whereby said predetermined length corresponds to a tuned harmonic length upon placement of said string into assembled position across said nut and said bridge critical contact surface on the associated musical instrument.

16. The string of claim 15, wherein said predetermined length is equal to about the distance between said nut and said bridge critical contact surface plus no greater than 0.350 inch.

17. The string of claim 15, further comprising a first bullet affixed to said first end and a second bullet affixed to said second end.

18. The string of claim 17, wherein said predetermined length is equal to the distance between said nut and said bridge critical contact surface plus 0.350 inch.

19. The set of strings of claim 17, wherein said first and second anchors comprises respective first and second bullets.

20. A string for a musical instrument, said string comprising a first end and a second end and having a predetermined length between said first and second ends, said predetermined length selected to correspond with a convergence length at which harmonic and pitch tuning are simultaneously and instantly obtained upon placement of said string in its assembled position within an associated stringed instrument.

21. The string of claim 20, further comprising a first anchor affixed to said first end and a second anchor affixed to said second end.

22. The set of strings of claim 21, wherein said first and second anchor comprises respective first and second bullets.

23. The string of claim 20, wherein said musical instrument is a guitar including a nut and a bridge having a bridge critical contact surface spaced at a desired distance from said nut, said convergence length being equal to the distance between said nut and said bridge critical contact surface plus an additional distance required to permit tuning of the guitar in such a manner so as to simultaneously obtain harmonic and pitch tuning of said string.

24. A string for a musical instrument, said string comprising a first end and second end, a first bullet-shaped anchor arranged at said first end, and a second bullet-shaped anchor arranged at said second end, said string exiting said first and second bullet-shaped anchors at respective first and second termination points, said string including a single unencumbered strand at said first and second termination points.

25. A string for a musical instrument, said string comprising a first end and a second end, and having a apredetermined length between said first and second ends, said predetermined length selected to correspond with a convergence length at which harmonic and pitch tuning are simultaneously and instantly obtained upon placement of said string in its assembled position within an associated stringed instrument, a first anchor arranged at said first end and a second anchor arranged at said second end, said string exiting said first and second anchors at respective first and second termination points, said string including a single unencumbered strand at said first and second termination points.

* * * * *

UNITED STATES PATENT AND TRADEMARK OFFICE
CERTIFICATE OF CORRECTION

PATENT NO. : 5,700,965

DATED : December 23, 1997

INVENTOR(S) : Rose

It is certified that error appears in the above-identified patent and that said Letters Patent is hereby corrected as shown below:

Column 7, line 63, "1ever" should read --lever--.

Column 11, line 55, "this" should read --is--.

Column 14, lines 51 and 52, "arranged close to, or in abutment termination point 76, where it exists the corresponding with the string holder 40." should read --arranged close to, or in abutment with, the string holder 40.--.

Column 15, line 27, "tighten" should read --tightened--.

Column 15, line 27, "string of" should read --of string--.

Column 25, line 33, "86" should read --186--.

Column 29, line 47, "plus 0.350 inch." should read -- plus no greater than 0.350 inch.--.

Column 30, lines 34, 35, "a aprede-
termined"
should read --a predetermined--.

Signed and Sealed this

Second Day of June, 1998

*Attest:*

Bruce Lehman

BRUCE LEHMAN

*Attesting Officer*

*Commissioner of Patents and Trademarks*